US010684564B2

(12) United States Patent
Fujiwara

(10) Patent No.: US 10,684,564 B2
(45) Date of Patent: Jun. 16, 2020

(54) ELECTROPHOTOGRAPHIC PHOTORECEPTOR AND IMAGE FORMING APPARATUS

(71) Applicant: KYOCERA Corporation, Kyoto-shi, Kyoto (JP)

(72) Inventor: Yoshiaki Fujiwara, Higashiomi (JP)

(73) Assignee: KYOCERA Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 16/466,552

(22) PCT Filed: Dec. 27, 2017

(86) PCT No.: PCT/JP2017/047114

§ 371 (c)(1),
(2) Date: Jun. 4, 2019

(87) PCT Pub. No.: WO2018/124244

PCT Pub. Date: Jul. 5, 2018

(65) Prior Publication Data

US 2020/0081359 A1 Mar. 12, 2020

(30) Foreign Application Priority Data

Dec. 28, 2016 (JP) ..... 2016-256641

(51) Int. Cl.

| | |
|---|---|
| ***G03G 5/00*** | (2006.01) |
| ***G03G 5/147*** | (2006.01) |
| ***G03G 15/00*** | (2006.01) |
| ***G03G 5/10*** | (2006.01) |

(52) U.S. Cl.

CPC ..... *G03G 5/14708* (2013.01); *G03G 5/10* (2013.01); *G03G 5/147* (2013.01); *G03G 15/751* (2013.01)

(58) Field of Classification Search

CPC ..... G03G 5/147; G03G 5/10
USPC ..... 430/66, 69
See application file for complete search history.

(56) References Cited

FOREIGN PATENT DOCUMENTS

| | | | |
|---|---|---|---|
| JP | 63-129348 | A | 6/1988 |
| JP | 2006-119549 | A | 5/2006 |
| JP | 2011-221144 | A | 11/2011 |
| JP | 2016-186574 | A | 10/2016 |

*Primary Examiner* — Mark A Chapman
(74) *Attorney, Agent, or Firm* — Volpe and Koenig, P.C.

(57) ABSTRACT

An electrophotographic photoreceptor includes a cylindrical substrate; and a surface layer located on an outer surface of the cylindrical substrate. At least a substrate central portion in a cylindrical axial direction of the outer surface of the cylindrical substrate is formed as a rough surface, and a surface roughness of a surface-layer central portion in the cylindrical axial direction of an outer surface of the surface layer is larger than that of at least one of two surface-layer end portions in the cylindrical axial direction of the outer surface of the surface layer. An image forming apparatus includes the electrophotographic photoreceptor; and a peripheral member capable of contacting a surface of the electrophotographic photoreceptor.

9 Claims, 12 Drawing Sheets

ELECTROPHOTOGRAPHIC PHOTORECEPTOR AND IMAGE FORMING APPARATUS

CROSS-REFERENCE TO RELATED APPLICATIONS

This application is a national stage entry according to 35 U.S.C. 371 of International Application No. PCT/JP2017/047114 filed on Dec. 27, 2017, which claims priority to Japanese Patent Application No. 2016-256641 filed on Dec. 28, 2016, the contents of which are entirely incorporated herein by reference.

TECHNICAL FIELD

The present disclosure relates to an electrophotographic photoreceptor and an image forming apparatus including the same.

BACKGROUND

In the related art, an electrophotographic photoreceptor has a configuration in which a surface layer including a charge injection blocking layer, a photoconductive layer, a surface protective layer, and the like is formed on the surface of a cylindrical substrate and the like as described in, for example, Patent Literature 1 (for example, Patent Literatures 1 to 4).

CITATION LIST

Patent Literature

Patent Literature 1: Japanese Unexamined Patent Publication JP-A 63-129348

Patent Literature 2: Japanese Unexamined Patent Publication JP-A 2011-221144

Patent Literature 3: Japanese Unexamined Patent Publication JP-A 2016-186574

Patent Literature 4: Japanese Unexamined Patent Publication JP-A 2006-119549

SUMMARY

An electrophotographic photoreceptor according to the present disclosure includes a cylindrical substrate and a surface layer located on an outer surface of the cylindrical substrate. At least a substrate central portion in a cylindrical axial direction of the outer surface of the cylindrical substrate is formed as a rough surface. A surface roughness of a surface-layer central portion in a cylindrical axial direction of an outer surface of the surface layer is larger than that of at least one of two surface-layer end portions in the cylindrical axial direction of the outer surface of the surface layer.

An image forming apparatus according to the present disclosure includes the above-described electrophotographic photoreceptor, and a peripheral member capable of contacting the electrophotographic photoreceptor.

DETAILED DESCRIPTION

Hereinafter, an electrophotographic photoreceptor according to an embodiment and an image forming apparatus provided with the same will be described with reference to the drawings. In addition, the following contents illustrate embodiments of the present disclosure, and the present disclosure is not limited to examples of the embodiments.

(Electrophotographic Photoreceptor)

An electrophotographic photoreceptor according to the embodiment will be described with reference to FIGS. 1A and 1B.

Figure 1A:
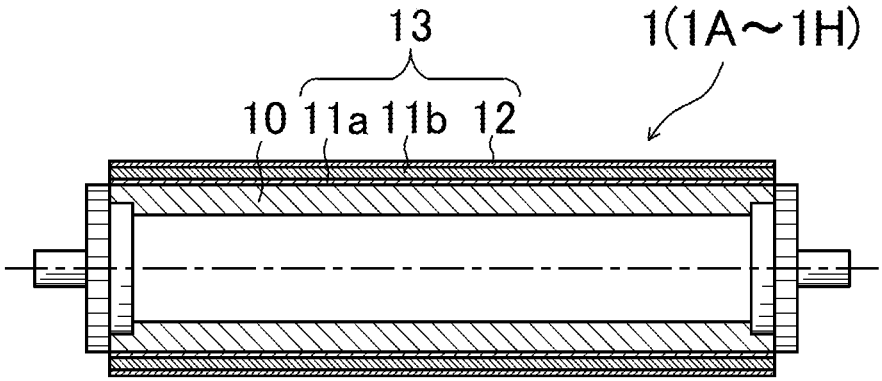
FIG. 1A is a cross-sectional view illustrating an electrophotographic photoreceptor according to an embodiment.
Figure 1B:
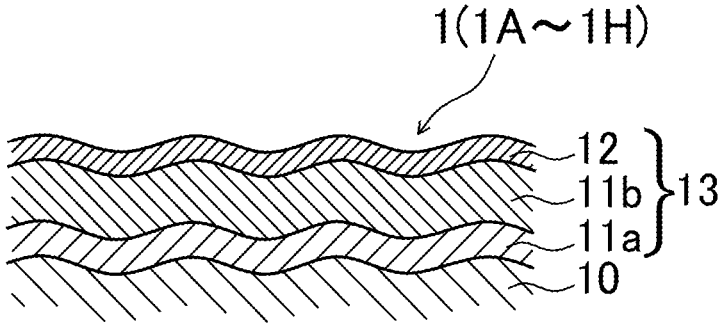
FIG. 1B is a cross-sectional view of a principal portion of FIG. 1A.

The electrophotographic photoreceptor 1 illustrated in FIGS. 1A and 1B includes a photosensitive layer 11 in which a charge injection blocking layer 11*a* and a photoconductive layer 11*b* are sequentially formed, on the outer surface of a cylindrical substrate 10. A surface protective layer 12 is deposited on the outer surface of the photosensitive layer 11. In addition, herein, a surface layer 13 includes the photosensitive layer 11 and the surface protective layer 12.

The cylindrical substrate 10 is a support of the photosensitive layer 11, and at least the surface of the cylindrical substrate 10 has conductivity.

The cylindrical substrate 10 is formed as a substrate having conductivity as a whole, for example, by using a metal material such as aluminum (Al), stainless steel (SUS), zinc (Zn), copper (Cu), iron (Fe), titanium (Ti), nickel (Ni), chromium (Cr), tantalum (Ta), tin (Sn), gold (Au), silver (Ag), magnesium (Mg), and manganese (Mn) or an alloy material containing the exemplified metal materials. In addition, the cylindrical substrate 10 may be a substrate formed by depositing a conductive film made of the exemplified metal material and a transparent conductive material such as ITO (indium tin oxide) or $SnO_2$ (tin dioxide) on the surface made of a resin, glass, or ceramics. Among these exemplified materials, an aluminum (Al)-based material may be used as a material for forming the cylindrical substrate 10, and the entire cylindrical substrate may be formed by using the aluminum (Al)-based material. Then, the electrophotographic photoreceptor 1 can be manufactured at a low weight and at a low cost. Furthermore, in a case where the charge injection blocking layer 11*a* and the photoconductive layer 11*b* are formed by using an amorphous silicon (a-Si)-based material, the adhesion between the layers and the cylindrical substrate 10 becomes high, so that it is possible to improve the reliability.

The surface of the cylindrical substrate 10 may be roughened. The surface roughness of the cylindrical substrate 10 may be, for example, 50 nm<Sa<140 nm after roughening. In addition, as a method of roughening, for example, wet blast, sputter etching, gas etching, polishing, turning, wet etching, electric galvanic corrosion, or the like may be used. A drawn pipe that satisfies the above-mentioned surface roughness may be used as it is without performing surface treatment for adjusting the surface shape. In addition, in the present disclosure, a portion (surface area) where the arithmetic mean height Sa of the surface is 25 nm or more is called a "rough surface".

In addition, the surface of the cylindrical substrate 10 may be surface-mirroring-processed before the above-mentioned surface roughening, but in such a case, it is preferable to perform oil removal after the surface mirroring processing before the surface roughening. Furthermore, the surface roughness of the cylindrical substrate 10 may be, for example, Sa<25 nm after the surface mirroring processing. In addition, in the present disclosure, a portion (surface area) where the arithmetic mean height Sa of the surface is less than 25 nm is referred to as a "mirror surface".

In the present specification, Sa (arithmetic mean roughness) is one of the parameters representing a three-dimensional surface texture defined by ISO25178 and represents the arithmetic mean roughness (nm) of the absolute value of the height of the surface in the measurement target region from the average surface. In addition, the measurement as the evaluation of the surface shape with the three-dimensional roughness parameter based on ISO25178 was carried out by a three-dimensional measurement laser microscope OLS4100 produced by Olympus Co., Ltd described below. In addition, the measurement of the electrophotographic photoreceptor (surface layer) was carried out on the product surface as it is, and the measurement of the outer surface (outer circumferential surface) of the cylindrical substrate under the surface layer was carried out after removing the surface layer from the product of the electrophotographic photoreceptor by dry etching using $ClF_3$, $CF_4$, or the like.

In addition, the surface texture of the electrophotographic photoreceptor 1 needs not to satisfy a predetermined range over the entire surface of the surface protective layer 12. For example, in both end portions or the like of the cylindrical substrate 10 in the axial direction which do not contact the cleaning roller 116B or the cleaning blade 116A, the surface texture may have a value out of the range. This is the same for all the parameters of the surface texture described below.

The charge injection blocking layer 11*a* has a function of blocking injection of carriers (electrons) from the cylindrical substrate 10. The charge injection blocking layer 11*a* is made of, for example, an amorphous silicon (a-Si)-based material. The charge injection blocking layer 11*a* may be formed, for example, by using an amorphous silicon (a-Si) containing nitrogen (N) or oxygen (O) or both in the case of containing boron (B) as a dopant or by using an amorphous silicon (a-Si) containing nitrogen (N) or oxygen (O) or both in the case of containing phosphorus (P) as a dopant, and the thickness thereof is set to 2 μm or more and 10 μm or less.

The photoconductive layer 11*b* has a function of generating carriers by light irradiation such as laser light. The photoconductive layer 11*b* is made of, for example, an amorphous silicon (a-Si)-based material and an amorphous selenium (a-Se)-based material such as Se—Te or $As_2Se_3$. The photoconductive layer 11*b* in the present example is made of amorphous silicon (a-Si) and an amorphous silicon (a-Si)-based material obtained by adding carbon (C), nitrogen (N), oxygen (O), and the like to amorphous silicon (a-Si) and contains boron (B) or phosphorus (P) as a dopant.

In addition, the thickness of the photoconductive layer 11*b* may be appropriately set in accordance with the photoconductive material to be used and the desired electrophotographic characteristics. In a case where the photoconductive layer 11*b* is formed by using an amorphous silicon (a-Si)-based material, the thickness of the photoconductive layer 11*b* may be set to, for example, 5 μm or more and 100 μm or less, and more specifically 10 μm or more and 80 μm or less.

The surface protective layer 12 has a function of protecting the surface of the photosensitive layer 11. The surface protective layer 12 may be formed by using an amorphous silicon (a-Si) material such as amorphous silicon carbide (a-SiC) or amorphous silicon nitride (a-SiN) or amorphous carbon (a-C) or may be formed to have a multi-layer structure thereof. In the example, the surface protective layer 12 is formed to have a three-layer structure, and the third layer of the surface protective layer 12 which is the outermost surface after the surface layer formation is formed by employing high-resistant amorphous carbon (a-C) from the point of view of abrasion resistance against rubbing in the image forming apparatus.

The thickness of the surface protective layer 12 may be adjusted, for example, in accordance with the required number of durable electrophotographic photoreceptors, and it is not necessary to increase the thickness more than necessary. For example, the thickness may be set to 0.1 μm or more and 2 μm or less, and more specifically to 0.5 μm or more and 1.5 μm or less.

In the embodiment, the surface roughness of the surface protective layer 12 may be set to Str≥0.67, and more specifically to Str≥0.79. Accordingly, it is possible to exhibit excellent durability characteristics and to suppress the occurrence of an image abnormality. That is, it is possible to suppress the frictional resistance with the cleaning roller, the cleaning blade, and the like in the initial stage, and it is possible to maintain the surface roughness within a certain range even when the surface is gradually abraded during durable use. As a result, since it is possible to continue to effectively suppress the increase in the frictional resistance between the surface protective layer and the cleaning roller or the cleaning blade, it is possible to suppress image abnormalities such as abnormal streaks in the printed image.

In addition, the surface roughness of the surface protective layer 12 may be set to Sal≤10.3 μm. Furthermore, the surface roughness of the surface protective layer 12 may be set to Sal≥0.9 μm, and more specifically, may be set to Sal≤1.6 μm. Accordingly, it is possible to more effectively exhibit the above-described excellent durability characteristics and the reduction in image abnormality. That is, in the planar direction of the surface of the surface protective layer, due to the presence of the unevenness at a narrow pitch defined by the above-mentioned numerical values, it is possible to realize the reduction of the initial defect and the suppression of the increase in the frictional resistance during durable use.

In addition, in the present specification, Str (aspect ratio of surface texture) is one of the parameters representing the three-dimensional surface texture defined by ISO25178 and represents the aspect ratio of the surface texture. That is, Str is a scale that represents the uniformity of the surface texture, and the autocorrelation of the surface is defined by the ratio of the farthest lateral distance to the correlation value 0.2 to Sal. Str has a value in a range of 0 to 1. The larger the value, the stronger the isotropy, and the smaller the value, the stronger the anisotropy. In addition, in the present specification, Sal (shortest autocorrelation distance) is one of the parameters representing the three-dimensional surface texture defined by ISO25178, and represents the shortest autocorrelation distance (μm). Sal represents the closest lateral distance at which the surface autocorrelation attenuates to a correlation value of 0.2. That is, it represents the dominant minimum unevenness pitch in the lateral direction.

Herein, Sal and Str are values indicating the surface texture of the surface protective layer 12 of the electrophotographic photoreceptor 1 in the initial state, that is, the electrophotographic photoreceptor 1 before being repeatedly used many times in the image forming apparatus. This denotes that the values indicate the surface textures at the time of shipment from the factory for the electrophotographic photoreceptor 1 as a marketed product.

In addition, the surface protective layer 12 is excellent in transparency so as not to absorb or reflect light such as laser light irradiated to the electrophotographic photoreceptor 1. In addition, the surface protective layer 12 may have a surface resistance value (generally $10^{11}$ Ω·cm or more) capable of retaining an electrostatic latent image in image formation.

Figure 2:
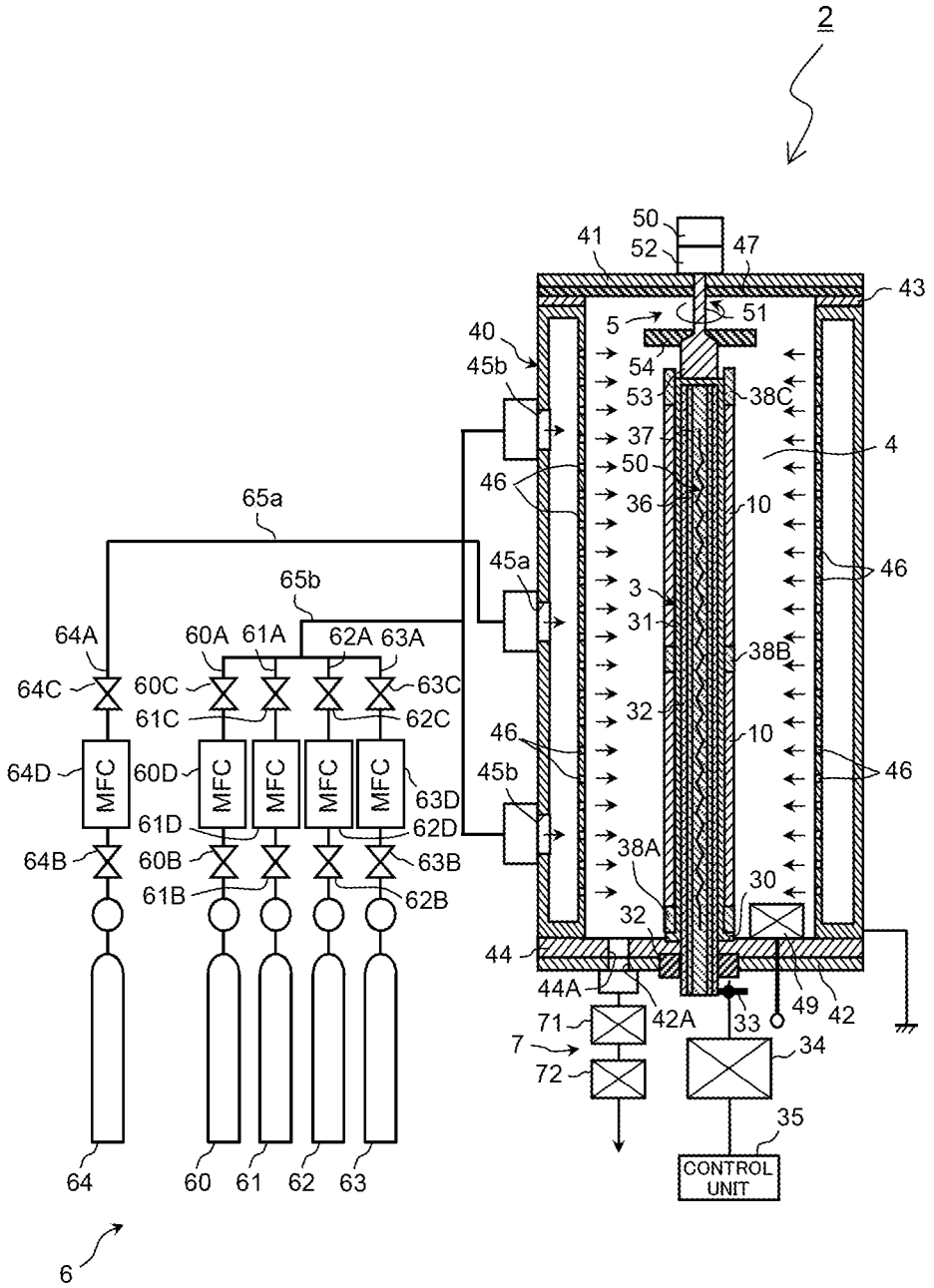
FIG. 2 is a longitudinal cross-sectional view of a deposition film forming apparatus.

The charge injection blocking layer 11*a*, the photoconductive layer 11*b*, and the surface protective layer 12 constituting the surface layer 13 of the electrophotographic photoreceptor 1 (including 1A to 1C) as described above are formed by using, for example, a plasma chemical vapor deposition (CVD) apparatus 2 illustrated in FIG. 2.

(Plasma CVD Apparatus)

The plasma CVD apparatus 2 accommodates a support 3 in a vacuum reaction chamber 4 and further includes rotating means 5, raw material gas supply means 6, and exhaust means 7.

The support 3 has a function of supporting the cylindrical substrate 10. The support 3 is formed in a hollow shape including a flange portion 30 and is entirely formed as a conductor by using a conductive material similar to that of the cylindrical substrate 10.

A conductive support column 31 is entirely made of a conductive material similar to that of the cylindrical substrate 10 as a conductor and is fixed to a plate 42 described below at the center of the vacuum reaction chamber 4 (cylindrical electrode 40 described below) via an insulating material 32. A DC power supply 34 is connected to the conductive support column 31 via a guide plate 33. The control unit 35 is configured to supply a pulsed DC voltage to the support 3 via the conductive support column 31 by controlling the DC power supply 34.

A heater 37 is accommodated in the conductive support column 31 via a ceramic pipe 36.

Herein, the temperature of the support 3 is maintained in a certain range selected from, for example, 200° C. or more and 400° C. or less by turning on and off the heater 37.

The vacuum reaction chamber 4 is a space for forming a deposition film on the cylindrical substrate 10 and is defined by a pair of plates 41 and 42 bonded via the cylindrical electrode 40 and insulating members 43 and 44.

The cylindrical electrode 40 is formed in such a size that the distance Dl between the cylindrical substrate 10 supported by the support 3 and the cylindrical electrode 40 is 10 mm or more and 100 mm or less.

The cylindrical electrode 40 may be provided with gas inlets 45*a* and 45*b* and a plurality of gas blowing-off holes 46 and may be grounded at one end of the cylindrical electrode 40. In a case where the cylindrical electrode 40 is not grounded, the cylindrical electrode 40 may be connected to a reference power supply other than the DC power supply 34.

The gas inlet 45*a* has a function of introducing a dopant-dedicated raw material gas of the photoconductive layer 11*b* to be supplied to the vacuum reaction chamber 4. The gas inlet 45*b* has a function of introducing a raw material gas to be supplied to the vacuum reaction chamber 4. Each of the gas inlets 45*a* and 45*b* is connected to the raw material gas supply means 6.

The plurality of gas blowing-off holes 46 have a function of blowing off the raw material gas introduced into the cylindrical electrode 40 toward the cylindrical substrate 10. The plurality of gas blowing-off holes 46 are arranged at equal intervals in the vertical direction of the figure and also arranged at equal intervals in the circumferential direction.

By opening and closing the plate 41, the support 3 can be taken in and out of the vacuum reaction chamber 4. In the plate 41, an adhesion prevention plate 47 is attached to the lower surface side, and a deposition film on the plate 41 is prevented from being formed.

The plate 42 is a base of the vacuum reaction chamber 4. The insulating member 44 interposed between the plate 42 and the cylindrical electrode 40 has a function of suppressing the occurrence of arc discharge between the cylindrical electrode 40 and the plate 42.

The plate 42 and the insulating member 44 are provided with gas outlets 42A and 44A and a pressure gauge 49. The gas outlets 42A and 44A have a function of exhausting the gas inside the vacuum reaction chamber 4. The pressure gauge 49 connected to the exhaust means 7 has a function of monitoring the pressure of the vacuum reaction chamber 4. As the pressure gauge 49, various known pressure gauges can be used.

As illustrated in FIG. 2, the rotating means 5 has a function of rotating the support 3 and includes a rotation motor 50 and a rotational force transmission mechanism 51.

The rotation motor 50 exerts a rotational force to the cylindrical substrate 10. As the rotation motor 50, various known rotation motors can be used.

The rotational force transmission mechanism 51 has a function of transmitting and inputting the rotational force from the rotation motor 50 to the cylindrical substrate 10. The rotational force transmission mechanism 51 has a rotation introducing terminal 52, an insulating shaft member 53 and an insulating flat plate 54.

The rotation introducing terminal 52 has a function of transmitting a rotational force while maintaining the vacuum in the vacuum reaction chamber 4.

The insulating shaft member 53 and the insulating flat plate 54 have a function of inputting the rotational force from the rotation motor 50 to the support 3 while maintaining the insulation state between the support 3 and the plate 41. The insulating shaft member 53 and the insulating flat plate 54 are made of, for example, the same insulating material as the insulating member 44 or the like.

The insulating flat plate 54 has a function of preventing foreign substances such as dirt and dust falling from above from adhering to the cylindrical substrate 10 in the case of detaching the plate 41.

As illustrated in FIG. 2, the raw material gas supply means 6 includes a plurality of raw material gas tanks 60, 61, 62, and 63, a dopant-dedicated gas tank 64 of the photoconductive layer 11*b*, a plurality of pipes 60A, 61A, 62A, 63A, and 64A, valves 60B, 61B, 62B, 63B, 64B, 60C, 61C, 62C, 63C, and 64C, and a plurality of mass flow controllers 60D, 61D, 62D, 63D, and 64D and is connected to the cylindrical electrode 40 via pipes 65*a* and 65*b* and the gas inlets 45*a* and 45*b*. Each of the raw material gas tanks 60 to 64 is filled with, for example, $B_2H_6$ (or $PH_3$), $H_2$ (or He), $CH_4$, or $SiH_4$. The valves 60B to 64B and 60C to 64C and the mass flow controllers 60D to 64D have a function of adjusting the flow rate, the composition, and the gas pressure of each raw material gas component introduced into the vacuum reaction chamber 4 or the dopant-dedicated gas component of the photoconductive layer 11*b*.

The exhaust means 7 has a function of exhausting the gas of the vacuum reaction chamber 4 to the outside through the gas outlets 42A and 44A. The exhaust means 7 includes a mechanical booster pump 71 and a rotary pump 72. These pumps 71 and 72 are controlled in operation according to the monitoring result of the pressure gauge 49.

As described above, such a plasma CVD apparatus 2 can continuously perform surface roughing and a process of forming the photosensitive layer 11 and the surface protective layer 12 while maintaining the vacuum state in the vacuum reaction chamber 4 in one apparatus. The plasma CVD apparatus 2 is an example of an apparatus of manufacturing an electrophotographic photoreceptor including a surface roughing unit, a charge injection blocking layer forming unit, a photoconductive layer forming unit, and a surface protective layer forming unit.

(Method of Forming Deposition Film)

Next, with respect to a method of forming a deposition film by using the plasma CVD apparatus 2, as an example, there will be described the case of manufacturing the electrophotographic photoreceptor 1 (refer to FIGS. 1A and 1B) in which an amorphous silicon (a-Si) film as the photosensitive layer 11, an amorphous silicon carbide (a-SiC) film as the surface protective layer 12, and amorphous carbon (a-C) film are stacked on the cylindrical substrate 10.

First, in forming the deposition film (a-Si film) on the cylindrical substrate 10, after detaching the plate 41 of the plasma CVD apparatus 2, the support 3 supporting a plurality of the cylindrical substrates 10 (two in the figure) is set inside the vacuum reaction chamber 4, and the plate 41 is attached again.

In order to support the two cylindrical substrates 10 with respect to the support 3, the lower dummy substrate 38A, the cylindrical substrate 10, the intermediate dummy substrate 38B, the cylindrical substrate 10, and the upper dummy substrate 38C are sequentially stacked on the flange portion 30 so as to cover the main portion of the support 3.

As each of the dummy substrates 38A to 38C, the dummy substrate obtained by applying conduction treatment to the surface of a conductive or insulating substrate is selected according to the application of the product, and generally, a material formed in a cylindrical shape similar to that of the cylindrical substrate 10 is used.

Herein, the lower dummy substrate 38A has a function of adjusting the height position of the cylindrical substrate 10. The intermediate dummy substrate 38B has a function of suppressing the occurrence of film formation defects on the cylindrical substrate 10 caused by the arc discharge generated between the ends of the adjacent cylindrical substrates 10. The upper dummy substrate 38C has a function of preventing the deposition film from being formed on the support 3 and of suppressing the occurrence of film formation defects caused by the peeling of a film formation body which has been once deposited during the film formation.

Next, the vacuum reaction chamber 4 is sealed. The cylindrical substrate 10 is rotated by the rotating means 5 via the support 3, and the cylindrical substrate 10 is heated. The vacuum reaction chamber 4 is depressurized by the exhaust means 7.

The cylindrical substrate 10 is heated, for example, by externally supplying power to the heater 37 to cause the heater to generate heat. The temperature of the cylindrical substrate 10 is set, for example, in a range of 250° C. or more and 300° C. or less in the case of forming an amorphous silicon (a-Si) film.

On the other hand, the depressurization of the vacuum reaction chamber 4 is carried out by exhausting the gas from the vacuum reaction chamber 4 through the gas outlets 42A and 44A by the exhaust means 7. The degree of depressurization of the vacuum reaction chamber 4 may be, for example, about $10^{-3}$ Pa while monitoring with the pressure gauge 49 (refer to FIG. 2).

Subsequently, in a case where the temperature of the cylindrical substrate 10 becomes a desired temperature and the pressure of the vacuum reaction chamber 4 becomes a desired pressure, the raw material gas is supplied to the vacuum reaction chamber 4 by the raw material gas supply means 6, and a pulsed DC voltage is applied between the cylindrical electrode 40 and the support 3. As a result, glow discharge occurs between the cylindrical electrode 40 and the support 3 (cylindrical substrate 10), and thus, the raw material gas component is decomposed, so that the decomposed components of the raw material gas are deposited on the surface of the cylindrical substrate 10.

On the other hand, due to the exhaust means 7, the gas pressure in the vacuum reaction chamber 4 is maintained in a target range. The gas pressure in the vacuum reaction chamber 4 may be, for example, 1 Pa or more and 100 Pa or less.

The supply of the raw material gas to the vacuum reaction chamber 4 is carried out by introducing the raw material gases of the raw material gas tanks 60 to 64 with desired composition and flow rates into the inside of the cylindrical electrode 40 through the pipes 60A to 64A, 65*a*, and 65*b*, and the gas inlets 45*a* and 45*b* by appropriately controlling the opened/closed states of the valves 60B to 64B and 60C to 64C and controlling the mass flow controllers 60D to 64D. Then, the charge injection blocking layer 11*a*, the photoconductive layer 11*b*, and the surface protective layer 12 are sequentially formed on the surface of the cylindrical substrate 10 by appropriately switching the composition of the raw material gases.

The application of the pulsed DC voltage between the cylindrical electrode 40 and the support 3 is carried out by controlling the DC power supply 34 by a control unit 35.

The pulsed DC voltage is applied so that the cylindrical substrate 10 side has either positive or negative polarity to accelerate cations and cause the cations to collide with the cylindrical substrate 10. In a case where the fine unevenness of the surface is sputtered by the collision and the film formation of amorphous silicon (a-Si) is carried out, the amorphous silicon (a-Si) including a surface with highly uniform unevenness in which the growth of large protrusions is suppressed is obtained. Hereinafter, in some cases, this phenomenon may be referred to as an ion sputtering effect.

In order to efficiently obtain the ion sputtering effect in such a plasma CVD method, it is necessary to apply power so as to avoid continuous inversion of the polarity, and in addition to the pulsed rectangular wave, a triangular wave, a DC voltage without inversion of polarity is useful. In addition, the same effect can be obtained with an AC voltage or the like adjusted so that all voltages have either positive or negative polarity.

Herein, in order to efficiently obtain the ion sputtering effect by the pulsed voltage, the potential difference between the support 3 (cylindrical substrate 10) and the cylindrical electrode 40 may be, for example, in a range of 50 V or more and 3000 V or less. In a case where the film formation rate is considered, more specifically, the potential difference may be in a range of 500 V or more and 3000 V or less.

The control unit 35 also controls the DC power supply 34 so that the frequency (1/T (sec)) of the DC voltage is 300 kHz or less and the duty ratio (T1/T) is 20% or more and 90% or less.

In addition, the duty ratio in the embodiment is defined as a ratio of time taken by a potential difference generation time T1 in one cycle (T) of a pulsed DC voltage (time period from the moment when the potential difference is generated between the cylindrical substrate 10 and the cylindrical electrode 40 to the moment when the potential difference is generated next).

Even when the thickness of the photoconductive layer 11*b* made of the amorphous silicon (a-Si) obtained by using the ion sputtering effect is 10 μm or more, as described above, highly uniform unevenness in which the growth of large protrusions is suppressed exists on the surface. For this reason, amorphous silicon carbide (a-SiC) and amorphous carbon (a-C) as the surface protective layer 12 may be stacked in a total thickness of about 1 μm on the outer surface of the photoconductive layer 11*b*. The surface shape of the surface protective layer 12 in this case can be a surface reflecting the surface shape of the photoconductive layer 11*b*. That is, even in a case where the surface protective layer 12 is stacked on the photoconductive layer 11*b*, the surface protective layer 12 can be formed as the film having highly uniform unevenness in which the growth of large protrusions is suppressed by using the ion sputtering effect.

For example, in a case where the charge injection blocking layer 11*a* is formed as a deposition film made of amorphous silicon (a-Si)-based material, a mixed gas of a silicon (Si) containing gas such as $SiH_4$ (silane gas), a dopant containing gas such as $B_2H_6$ or $PH_3$, and a dilution gas of hydrogen ($H_2$), helium (He), or the like is used as a raw material gas. As the dopant containing gas, a gas containing nitrogen (N) containing gas or oxygen (O) containing gas or both thereof may be used in the case of a boron (B) containing gas, or a gas containing nitrogen (N) containing gas or oxygen (O) containing gas or both thereof may be used in the case of a phosphorus (P) containing gas.

In a case where the photoconductive layer 11*b* is formed as a deposition film made of amorphous silicon (a-Si)-based material, a silicon (Si)-containing gas such as $SiH_4$ (silane gas) and a mixed gas of a dilution gas of hydrogen ($H_2$), helium (He), or the like may be used as raw material gases. In the photoconductive layer 11*b*, a hydrogen gas may be used as a dilution gas so that hydrogen (H) or a halogen element (fluorine (F) or chlorine (Cl)) is contained in the film in an amount of 1 atomic % or more and 40 atomic % or less for termination of dangling bonds, or a halogen compound may be contained in the raw material gas.

The surface protective layer 12 is formed as a multilayer structure of the a-SiC layer and the a-C layer as described above. In this case, as the raw material gas, a silicon (Si)-containing gas such as $SiH_4$ (silane gas) and a C-containing gas such as $C_2H_2$ (acetylene gas) or $CH_4$ (methane gas) are used. Herein, the a-C layer which is the third layer of the surface protective layer 12 may be set to have a thickness of usually 0.01 μm or more and 2 μm or less, specifically 0.02 μm or more and 1 μm or less, more specifically 0.03 μm or more and 0.8 μm or less. In addition, the surface protective layer 12 may be set to have a thickness of usually 0.1 μm or more and 6 μm or less, specifically 0.25 μm or more and 3 μm or less, more specifically 0.4 μm or more and 2.5 μm or less.

As described above, in a case where the film formation on the cylindrical substrate 10 is completed, the electrophotographic photoreceptor 1 illustrated in FIG. 1 can be obtained by extracting the cylindrical substrate 10 from the support 3.

(Image Forming Apparatus)

An image forming apparatus according to an embodiment of the present disclosure will be described with reference to FIG. 3.

Figure 3:
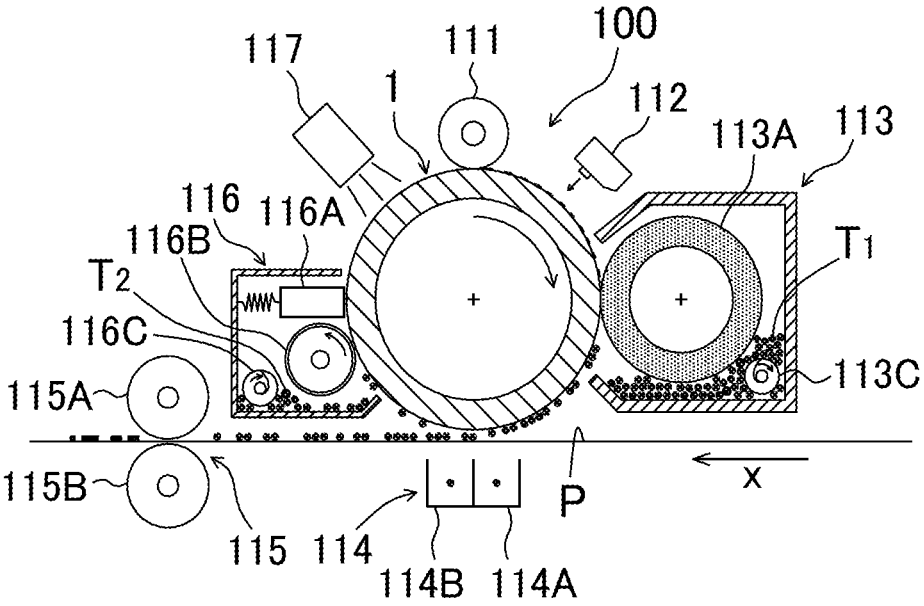
FIG. 3 is a cross-sectional view illustrating an image forming apparatus according to the embodiment.

The image forming apparatus illustrated in FIG. 3 employs a Carlson method as an image forming method and includes the electrophotographic photoreceptor 1, a charging device including a charging device 111, a non-contact exposure device 112, a developing device 113 including a magnetic roller 113A and a toner transporting screw 113C for stirring unused toner T1, a transfer device 114, a fixing device 115 (115A and 115B), a cleaning device 116 including a cleaning blade 116A and a cleaning roller 116B which contact the electrophotographic photoreceptor and a toner transporting screw 116C for discharging residual toner T2, and a non-contact static eliminating device 117. In addition, the arrow x in the drawing indicates the moving direction of the paper which is the recording medium P.

The charging device 111 has a function of charging the surface of the electrophotographic photoreceptor 1 to either positive or negative polarity. The charging voltage is set to, for example, 200 V or more and 1000 V or less. In the embodiment, as the charging device 111, for example, a contact charging device configured by covering a core metal with a conductive rubber or polyvinylidene fluoride (PVDF) is employed. Instead of this, as the charging device 111, a non-contact charging device (for example, a corona charging device) including a discharge wire may be employed.

The exposure device 112 has a function of forming an electrostatic latent image on the electrophotographic photoreceptor 1. Specifically, the exposure device 112 irradiates the electrophotographic photoreceptor 1 with exposure light (for example, laser light) having a specific wavelength (for example, 650 nm or more and 780 nm or less) according to an image signal to attenuate the potential of the exposure light irradiated portion of the electrophotographic photoreceptor 1 which is in a charged state, so that an electrostatic latent image is formed. As the exposure device 112, for example, a light emitting diode (LED) head in which a plurality of LED elements (wavelength: 680 nm) are arrayed can be employed.

Of course, as the light source of the exposure device 112, a light source capable of emitting a laser beam can be used instead of the LED element. That is, instead of the exposure device 112 such as the LED head, an optical system including a polygon mirror may be used. Alternatively, the image forming apparatus can be configured as a copier by employing an optical system including a mirror and a lens through which light reflected from a document passes.

The developing device 113 has a function of developing an electrostatic latent image of the electrophotographic photoreceptor 1 to form a toner image. The developing device 113 in the example is provided with the magnetic roller 113A that retains the developer (toner) T magnetically.

The developer (toner) T constitutes a toner image formed on the surface of the electrophotographic photoreceptor 1 and is frictionally charged in the developing device 113. As the developer T, there are exemplified a two-component developer including a magnetic carrier and an insulating toner and a one-component developer including a magnetic toner. In addition, the unused toner in the developing device 113 is indicated by T1, and the remaining (used) toner in the cleaning device 116 is indicated by T2.

The magnetic roller 113A has a function of transporting the developer to the surface (developing region) of the electrophotographic photoreceptor 1. The magnetic roller 113A transports the developer T, which is frictionally charged in the developing device 113, in the form of a magnetic brush adjusted to a constant brush length. The transported developer T adheres to the surface of the electrophotographic photoreceptor 1 by electrostatic attraction with the electrostatic latent image in the developing region of the electrophotographic photoreceptor 1 to form a toner image (to visualize the electrostatic latent image). In a case where image formation is carried out by normal development, the charge polarity of the toner image is set to be opposite to the charge polarity of the surface of the electrophotographic photoreceptor 1. In a case where image formation is carried out by inversion development, the charge polarity of the toner image is set to be the same as the charge polarity of the surface of the electrophotographic photoreceptor 1.

In addition, although the developing device 113 employs a dry development method in the present example, a wet development method using a liquid developer may be employed. In addition, in some cases, in the developing device 113, the toner transporting screw 113C (spiral type) for stirring the unused toner T1 is arranged.

The transfer device 114 has a function of transferring the toner image of the electrophotographic photoreceptor 1 to the recording medium P supplied to a transfer region between the electrophotographic photoreceptor 1 and the transfer device 114. The transfer device 114 in the present example includes a transfer charger 114A and a separation charger 114B. In the transfer device 114, the back surface (non-recording surface) of the recording medium P is charged to have the charge polarity opposite to the charge polarity of the toner image in the transfer charger 114A, and the toner image is transferred on the recording medium P by the electrostatic attraction between the charged charge and the toner image. In addition, in the transfer device 114, the back surface of the recording medium P is AC-charged in the separation charger 114B simultaneously with the transfer of the toner image, and the recording medium P is quickly separated from the surface of the electrophotographic photoreceptor 1.

As the transfer device 114, in some cases, a transfer roller which follows the rotation of the electrophotographic photoreceptor 1 and which is arranged via a minute gap (for example, 0.5 mm or less) with the electrophotographic photoreceptor 1 may be used. The transfer roller is configured so that, for example, by a DC power supply applies a transfer voltage for attracting the toner image on the electrophotographic photoreceptor 1 onto the recording medium P. In a case where the transfer roller is used, a transfer separation device such as the separation charger 114B can be omitted.

The fixing device 115 has a function of fixing the toner image transferred to the recording medium P to the recording medium P and includes a pair of fixing rollers 115A and 115B. The fixing rollers 115A and 115B are obtained, for example, by coating the surface of a metal roller with tetrafluoroethylene or the like. The fixing device 115 can fix the toner image on the recording medium P by applying heat and pressure to the recording medium P passing between the pair of fixing rollers 115A and 115B.

The cleaning device 116 has a function of removing toner remaining on the surface of the electrophotographic photoreceptor 1 and includes a cleaning roller 116B and a cleaning blade 116A. The cleaning roller 116B is in a shape of a crown having a large diameter at the center and slidingly contacts the outer circumference of the electrophotographic photoreceptor 1 and forms a toner film for surface cleaning, which is made of residual toner T2 therebetween. The cleaning blade 116A has a function of scraping the residual toner from the surface of the electrophotographic photoreceptor 1. The cleaning blade 116A is made of, for example, a rubber material containing a polyurethane resin as a main component.

The static eliminating device 117 has a function of removing surface charges of the electrophotographic photoreceptor 1. The static eliminating device can emit light having a specific wavelength (for example, 630 nm or more). The static eliminating device 117 is configured to remove the surface charges (remaining electrostatic latent image) of the electrophotographic photoreceptor 1 by irradiating the entire surface of the electrophotographic photoreceptor 1 in the axial direction with light from a light source such as an LED.

In the image forming apparatus 100 according to the embodiment, it is possible to exhibit the above-described effects of the electrophotographic photoreceptor 1.

Example 1

The electrophotographic photoreceptor 1 according to the embodiment of the present disclosure was evaluated as follows.

With Respect to Manufacturing Electrophotographic Photoreceptor 1

<Cylindrical Substrate 10>

The cylindrical substrate 10 was manufactured by using an aluminum alloy raw tube (outside diameter: 30 mm and length: 360 mm). The outer surface of the cylindrical substrate 10 was subjected to surface mirroring processing and wet blasting processing to be cleaned.

First, as the surface mirroring processing of the surface of the cylindrical substrate 10, the cylindrical substrate 10 was retained at the two ends thereof, and in the state of rotating at a high speed of 1500 to 8000 rpm, the diamond turning tool was pressed against the cylindrical substrate 10, and a vanishing process was carried out at a feed of 0.08 to 0.5 mm. That is, a smooth finished surface was obtained by pressing the surface of the cylindrical substrate 10 with a diamond turning tool having a depth in the direction of work rotation on the finished surface of the turning tool.

After the surface mirroring processing, the cylindrical substrate 10 was degreased and cleaned.

Next, as the wet blasting processing, a high-hardness abrasive such as alumina and water are stirred and accelerated while being mixed with compressed air, and the surface of the surface-mirroring-processed cylindrical substrate 10 was roughened by projecting the abrasive. Accordingly, by processing while rotating the cylindrical substrate 10, it is possible to form a processed surface with excellent uniformity in a short time. As in the embodiment, according to the wet blasting processing, as compared with other processing methods, uniformly projecting the abrasive having a small particle size can be relatively easily carried out, so that it is possible to obtain a processed surface with excellent uniformity.

Specifically, samples of the cylindrical substrate 10 including 15 types of different surfaces listed in Table 2 described below were prepared by adjusting the following parameters as the conditions for the wet blasting processing (Example 1).

In addition, by changing the moving speed of the abrasive projection nozzle in the wet blasting processing in the y direction described below of the cylinder, which was the cylindrical rotation axial direction or by leaving the portion where the abrasive material was not projected near the end portion in the cylindrical axial direction as a non-processed portion (mirrored surface portion) or the like, samples in which the roughness of the outer circumferential surface of the cylindrical substrate 10 before film formation processing was variously changed in the axial direction were prepared, and the electrophotographic photoreceptors (Example 2) according to the first to eighth embodiments were obtained by performing film formation on the outer circumferential surface of the cylindrical substrate 10 by using the above-mentioned plasma CVD apparatus 2. The first to eighth embodiments will be described again below.

Material and Particle Size of Abrasive: A (alundum (brown dissolved alumina)) #320 to #4000

Concentration of Abrasive: 10 to 18%

Projection Air Pressure: 0.10 to 0.35 MPa

Projection Distance (Distance between Work Center and Blast Head): 20 to 300 mm

Projection Time: 1 to 60 seconds

Work Speed: 120 to 180 rpm

In addition, the value of Sal was adjusted by using abrasives having different materials and particle sizes, and the value of Str was adjusted by changing the projection air pressure, the projection distance, and the projection time (1 to 60 seconds).

In addition, in the wet blasting processing, the used abrasive (medium) is washed away from the surface of the work by washing with water (coarse water washing) to be recovered and classified by centrifugation or the like to be reused. That is, in the wet blasting processing, the coarse water washing is carried out in the blasting apparatus in order to minimize the fluctuation of the concentration of the abrasive in the blast flow. In the coarse water washing process, instead of the cleaning by using fresh water, cleaning is carried out by projecting the remaining water (containing small diameter abrasives and, hereinafter, is called "classification water") after the classification of the relatively large-diameter abrasives by centrifugation from the water containing the abrasives used for the blasting on the substrate (raw tube) immediately after blasting. By returning the abrasive adhering to the surface to the abrasive tank, the concentration in the blast flow of the abrasive is maintained.

Next, after performing the wet blasting, the residue remaining on the surface is cleaned and removed to prepare the cylindrical substrate 10 for forming the surface layer. The cleaning to remove the residue (residue cleaning process) is carried out in the order of shower cleaning with water ultrasonic cleaning—blowing (blowing with compressed air)–heater drying.

The cylindrical substrate 10 prepared in this manner is transported into a clean room, subjected to precision cleaning for removing oil components and the like, and then set in the plasma CVD apparatus illustrated in FIG. 2. After being set, the surface layer 13 including the charge injection blocking layer 11*a*, the photoconductive layer 11*b*, and the surface protective layer 12 is formed on the surface of the cylindrical substrate 10 under the conditions listed in Table 1.

TABLE 1

| | | | | Surface layer | | |
|---|---|---|---|---|---|---|
| Type of layer | | Charge injection blocking layer | Photoconductive layer | First layer | Second layer | Third layer |
| Type of gas | $SiH_4$ (sccm) | 170 | 340 | 30 | 6 | |
| | $H_2$ (sccm) | 200 | 200 | — | — | — |
| | $B_2H_6$* | 0.10% | 0.3 ppm | — | — | — |

TABLE 1-continued

| Type of layer | Charge injection blocking layer | Photoconductive layer | Surface layer First layer | Second layer | Third layer |
|---|---|---|---|---|---|
| $CH_4$ (sccm) | — | — | 600 | 600 | 600 |
| NO* | 10% | — | — | — | — |
| Pressure (Pa) | 60 | 60 | 60 | 60 | 60 |
| Temperature of substrate (° C.) | 300 | 300 | 250 | 250 | 250 |
| DC voltage (V) | −900 | −1000 | −400 | −400 | −400 |
| Pulse frequency (kHz) | 50 | 50 | 50 | 50 | 50 |
| Duty ratio (%) | 70 | 70 | 70 | 70 | 70 |
| Thickness (μm) | 5 | 14 | 0.3 | 0.7 | 0.2 |

*Flow rate with respect to $SiH_4$ gas

The flow rates of $B_2H_6$ and NO in Table 1 are expressed as a ratio to the flow rate of $SiH_4$. In addition, a DC pulse power supply (pulse frequency: 50 kHz, duty ratio: 70%) was used as a power supply of the plasma CVD apparatus. In addition, the film thickness was measured by analyzing the cross section with a scanning electron microscope (SEM) and an X-ray microanalyzer (XMA). The specific configuration of each layer is as follows.

<Charge Injection Blocking Layer>

The charge injection blocking layer 11*a* is formed by adding boron (B) as a dopant to an amorphous silicon (a-Si)-based material obtained by adding nitrogen (N) and oxygen (O) to amorphous silicon (a-Si).

The film thickness of the charge injection blocking layer 11*a* was set to 5 μm.

<Photoconductive Layer>

The photoconductive layer 11*b* is formed by adding boron (B) as a dopant to an amorphous silicon (a-Si)-based material obtained by adding carbon (C), nitrogen (N), oxygen (O), and the like to amorphous silicon (a-Si).

The film thickness of the photoconductive layer 11*b* was set to 14 μm.

<Surface Protective Layer>

The surface protective layer 12 has a configuration in which amorphous silicon carbide (a-SiC) and amorphous carbon (a-C) are stacked.

The film thickness of the surface protective layer 12 was set to 1.2 μm in total, and the film thickness of the surface protective layer third layer was set to 0.2 μm.

Herein, Samples 1 to 15 of the electrophotographic photoreceptor 1 were produced by changing the surface roughness of the surface protective layer 12.

The surface textures of the surface protective layer 12 of Samples 1 to 15 of the electrophotographic photoreceptor 1 obtained as described above were measured.

The measurement as the evaluation of the surface shape with the three-dimensional roughness parameter based on ISO25178 was carried out by a three-dimensional measurement laser microscope OLS4100 produced by Olympus Co., Ltd. As a measurement condition, a 50-fold magnification lens was used, and a range of 260 μm×261 μm was measured in a high-speed measurement mode. Since the measurement object has a cylindrical shape, the correction was carried out by correcting the curvature in the X and Y directions. In addition, in order to eliminate the influence of the periodic streaks of turning, the filter correction with the central wavelength λc=0.080 mm was developed, and each parameter was calculated. In addition, the measurement result herein is an arithmetic mean of the measurement results of five positions within a range of 100 mm in the central portion in the axial direction of the cylindrical substrate 10 of the electrophotographic photoreceptor 1.

The Str and Sal of each sample are as listed in Table 2 described below.

Subsequently, each sample of the manufactured electrophotographic photoreceptor 1 was incorporated into a color multifunction apparatus "TASKalfa 3550ci remodeling apparatus" manufactured by KYOCERA Document Solutions Inc., and for each sample, evaluation of an Sa reduction rate (%) of the surface protective layer 12 of the electrophotographic photoreceptor 1, evaluation of a scratch of the cleaning blade 116A, which is a peripheral member of the electrophotographic photoreceptor 1, and evaluation of the image characteristics by observing the surface contamination state of the charging roller at the time of continuous printing of 600,000 sheets (600 k) were carried out. Then, comprehensive evaluation was carried out, which is comprehensive evaluation on the basis of those individual characteristics.

Evaluation of each of the above-mentioned individual characteristics was carried out under the condition of the following. That is, under the evaluation environment of a room temperature of 23° C. and a relative humidity of 60%, at the time of continuous printing of 200,000 sheets, the time of continuous printing of 400,000 sheets, and the time of continuous printing of 600,000 sheets, the measurement of the surface texture of the electrophotographic photoreceptor 1 by the above-mentioned laser microscope and the observation of the presence or absence of scratches on the edge portion of the cleaning blade 116A and the surface contamination state of the charging roller by a magnifying glass (20-fold magnification) were carried out.

Herein, the Sa reduction rate (%) indicates the rate at which the value of Sa on the surface protective layer of the electrophotographic photoreceptor 1 is reduced from the initial value before the printing, and, for example, a case where the rate is described as 70% denotes that the value of Sa is 30% of that in the state before printing. In addition, in the data of the Sa reduction rate (%), the value marked with "*" indicates the Sa reduction rate (%) of the surface protective layer 12 of the electrophotographic photoreceptor 1 at the time of continuous printing of 200,000 sheets (200 k).

In addition, a damage mode of the cleaning blade 116A is as follows. Evaluation A indicates that, as a result of continuous printing of 200,000 sheets (200 k), some damages were observed on the cleaning blade 116A. Evaluation B indicates that clear damages were able to be seen on the cleaning blade 116A at the time of small number of times of printing of 1000 sheets or less.

The evaluation results are listed in Table 2.

TABLE 2

| Sample | Surface state of surface layer | | Individual characteristics | | | | Comprehensive |
|---|---|---|---|---|---|---|---|
| | | | Sa reduction rate [%] during durable use, | Damage of | Damage | Image | |
| No. | Str | Sal | 600k | blade | mode | characteristics | evaluation |
| 1 | 0.59 | 0.9 | 64* | poor | A | available | available |
| 2 | 0.67 | 1.0 | 65* | available | A | good | good |
| 3 | 0.79 | 0.9 | 68* | available | A | good | good |
| 4 | 0.58 | 1.6 | — | poor | B | available | available |
| 5 | 0.68 | 1.8 | 70 | excellent | — | excellent | excellent |
| 6 | 0.79 | 1.6 | 76 | excellent | — | excellent | excellent |
| 7 | 0.59 | 4.6 | — | poor | B | available | available |
| 8 | 0.67 | 4.5 | 57 | good | — | excellent | excellent |
| 9 | 0.79 | 4.7 | 66 | excellent | — | excellent | excellent |
| 10 | 0.58 | 9.7 | — | poor | B | poor | poor |
| 11 | 0.67 | 10.3 | 45 | good | — | excellent | excellent |
| 12 | 0.79 | 10.0 | 54 | good | — | excellent | excellent |
| 13 | 0.59 | 14.5 | — | poor | B | poor | poor |
| 14 | 0.67 | 14.7 | — | poor | B | poor | poor |
| 15 | 0.79 | 14.7 | — | poor | B | poor | poor |

In Table 2, "excellent" indicates that the sample has excellent properties, "good" indicates that the sample has favorable properties, "available" indicates that the sample has a required level of properties, and "poor" indicates that the sample does not satisfy a required level of properties.

That is, the following was found from the results of Table 2.

In the electrophotographic photoreceptor 1, except for a case where the initial defect occurs due to the value of Sal (Samples 14 and 15), in a case where the value of Str is 0.67 or more (Samples 2, 3, 5, 6, 8, 9, 11, and 12), it was found that excellent effects were exhibited. Among the samples, in a case where the value of Str is 0.79 or more (Samples 3, 6, 9, and 12), it was found that more excellent effects were exhibited.

According to these experimental data, when the value of Str is a predetermined value or more, the surface shape of the surface protective layer 12 has unevenness with high uniformity, so that the surface roughness can be maintained within a certain range even when the surface is gradually abraded during durable use. As a result, it is possible to effectively suppress the increase in frictional resistance between the surface protective layer 12 and the cleaning roller 116B or the cleaning blade 116A. Accordingly, it is considered that the defect of the cleaning blade 116A can be suppressed, and thus, image abnormalities such as abnormal streaks in the printed image can be reduced. In addition, it is considered that, as the cause of the initial defect in Samples 14 and 15, when the value of Sal is large, the frictional resistance with the cleaning roller and cleaning blade as peripheral members is large, and thus the defect of the cleaning blade 116A occurs.

In addition, the following was found under the condition that the value of Str was 0.67 or more. That is, in a case where the value of Sal was 10.3 μm or less (Samples 2, 3, 5, 6, 8, 9, 11, and 12), it was found that excellent effects were exhibited. According to these experimental data, it is considered that, when Sal is smaller than a predetermined value, it is possible to reduce the frictional resistance between the surface protective layer 12 of the electrophotographic photoreceptor 1 and the cleaning roller 116B or the cleaning blade 116A, so that it is possible to obtain excellent durability characteristics by suppressing the defect of the cleaning blade 116A.

In addition, in a case where the value of Sal was 0.9 μm or more (Samples 2, 3, 5, 6, 8, 9, 11, and 12), it was found that excellent effects were exhibited. Furthermore, in a case where the value of Sal was 1.6 μm or more (Samples 5, 6, 8, 9, 11, and 12), it was found that more excellent effects were exhibited. According to these experimental data, it is considered that, when Sal is larger than a predetermined value, the abrasion of the surface protective layer 12 of the electrophotographic photoreceptor 1 is reduced, so that it is possible to obtain excellent durability characteristics by suppressing the defect of the cleaning blade 116A.

Example 2

Next, Example 2 will be described in which the surface roughness is changed in the cylindrical axial direction (the width direction of the cylinder) in response to the peripheral members arranged around the electrophotographic photoreceptor.

FIGS. 4 to 11 are exploded perspective views illustrating the relationship between the surface roughness of the electrophotographic photoreceptors (1A to 1H) according to the first to eighth embodiments of the present disclosure before forming the surface layer and the peripheral members arranged around the electrophotographic photoreceptors. In addition, each figure illustrates that various peripheral members arranged in a contact/non-contact manner around the rotation axis of the electrophotographic photoreceptor 1 are actually developed in the same plane and arranged in a line as illustrated in FIG. 3 and explains the change of the surface roughness of the outer surface of the cylindrical substrate 10 before forming the charge injection blocking layer in the cylindrical width direction (cylindrical axial direction and the y direction in the figure) in relation to the position of an image printing portion (between dotted lines) and the width of each peripheral member.

Moreover, in each figure, the change of the roughness (surface roughness) of the outer surface in the width direction (y direction) appears stepwise due to hatching (point density), but in the actual change of the surface roughness (surface roughness profile), as illustrated in the schematic views in the lower portion of each drawing, the surface roughness is designed such that the roughness changes gradually in the axial direction (y direction), that is, gradually or gently in the cylindrical axial direction.

Furthermore, in FIGS. 4, 5, 8, 9, and 11, the portion of the electrophotographic photoreceptor not drawn with hatching is a surface (substrate mirror surface portion where wet-blasting is not carried out) on which Sa after the surface mirroring processing is less than 25 nm as described above and the surface of the surface layer 13 is a "surface-layer mirror surface portion (reference numeral 13B)" of Sa<25 nm after the surface layer is formed. The symbols A to K representing sections (blocks) are provided to make it easy to see the positional relationship in the width direction between the exploded perspective view and the schematic view. It does not mean that the change in roughness in the cylindrical axial direction (y direction in the figure) changes stepwise in units of a block. In addition, the "image printing portion" in which the toner is actually transferred to the sheet corresponds to the illustrated blocks B to J.

Figure 4:
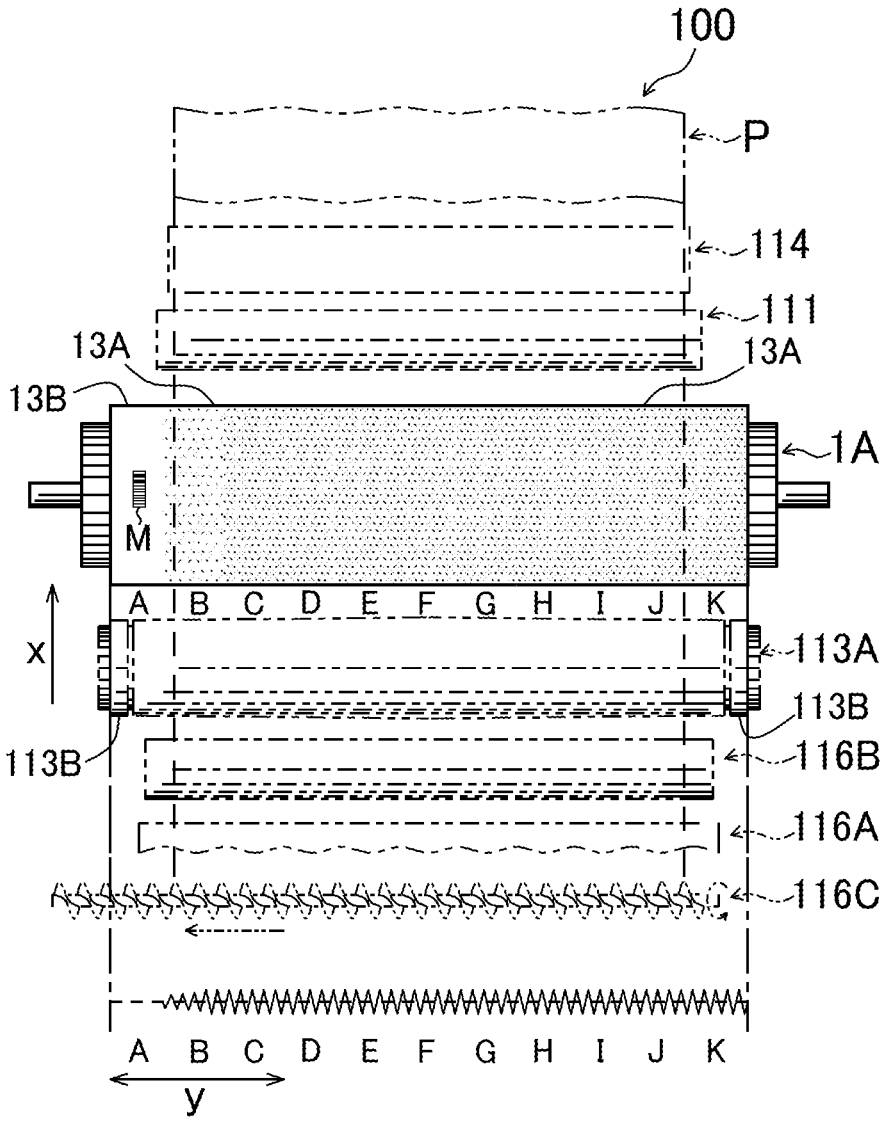
FIG. 4 is an exploded perspective view illustrating a relationship between surface roughness of an electrophotographic photoreceptor according to a first embodiment and peripheral members and a schematic view visually illustrating a change in surface roughness of the outer circumferential surface of a cylindrical substrate 10 of an electrophotographic photoreceptor 1A in the width direction as a difference between a peak and a valley.

The electrophotographic photoreceptor 1A according to the first embodiment illustrated in FIG. 4 is configured by using a cylindrical substrate 10 (raw tube) including an outer surface of a surface roughness profile as illustrated in the schematic view. That is, the electrophotographic photoreceptor 1A is formed based on a raw tube which has outer surface roughness (arithmetic mean height Sa) of, for example, 70 nm in the central portion of the substrate in the cylindrical axial direction and less than 25 nm in one substrate end portion (block A in the left side illustrated in the figure) of both end portions in the axial direction and whose surface roughness of the substrate central portion is larger than the surface roughness of one substrate end portion. In the substrate, the surface roughness of the surface layer 13 of the electrophotographic photoreceptor 1A after the film formation also conforms to the surface shape of the cylindrical substrate 10 (raw tube), and the surface roughness of the surface-layer central portion is larger than the surface roughness of one surface-layer end portion.

In addition, the image printing portions (blocks B to J) in the surface layer 13 of the electrophotographic photoreceptor 1A are rough surfaces having a surface roughness Str of 0.67 or more. In addition, on the outer circumferential surface of the cylindrical substrate 10 before forming the surface layer, the boundary (block B) between the block A which is a mirror surface portion of the substrate having an Sa of less than 25 nm and the block C which is a rough surface is formed to have a roughness gradient surface where the surface roughness gradually increases from the mirror surface to the rough surface as illustrated in the surface roughness profile in FIG. 4. Therefore, peeling of the film (surface layer) at the boundary portion between the mirror surface and the rough surface is less likely to occur.

Then, the block A (surface-layer mirror surface portion described below) which is a mirror surface is provided with an identification portion M having a surface roughness larger than that of the mirror surface at one place in the circumferential direction. This identification portion may be, for example, an individual identification code portion for identifying each of the electrophotographic photoreceptors as illustrated in FIG. 4. The individual identification code portion is a barcode using surface roughness (striations) that changes in the circumferential direction. In addition, the identification portion may be a guide mark portion serving as an index of circumferential rotation of the cylindrical substrate. In the example of illustration, the identification portion M functions as the individual identification code and the reference standard of rotation speed measurement of the circumferential direction rotation. In addition, in the electrophotographic photoreceptor 1 after the film formation (formation of the surface layer 13), a portion (surface area) where the arithmetic mean height Sa of the surface is less than 25 nm is referred to as a "surface-layer mirror surface portion" (reference numeral 13B).

In addition, when the rollers 113B and 113B which regulate the gap (developing gap) between the electrophotographic photoreceptor 1A and the magnetic roller 113A in the developing device 113 at the two ends by the contact and the above-described guide mark portion M are at the same position in the cylindrical width direction, the roller 113B rides on the guide mark portion M, and thus, the distance (gap) between the electrophotographic photoreceptor 1A and the magnetic roller 113A changes. For this reason, as illustrated in FIG. 4, the guide mark portion M is provided in the surface-layer mirror surface portion 13B (block A) at a position out of the position (outer edge) where the roller 113B abuts.

According to the electrophotographic photoreceptor having the above-described configuration, in a case where the electrophotographic photoreceptor is used as an image forming apparatus as illustrated in the figure, as described above, the peeling of the film (surface layer) at the boundary portion between the mirror surface and the rough surface is unlikely to occur, and it is possible to prevent image abnormalities caused by the peeled fragments from occurring in advance. In addition, the outermost surface (outer circumferential surface of surface layer 13) of the image printing portion (blocks B to J) that contacts the peripheral members such as the cleaning roller (sliding roller) and the cleaning blade is formed to be a rough surface having a surface roughness Str≥0.67. As a result, even when used repeatedly many times, image abnormalities are unlikely to occur, and the same electrophotographic photoreceptor can be used for a long time.

Figure 5:
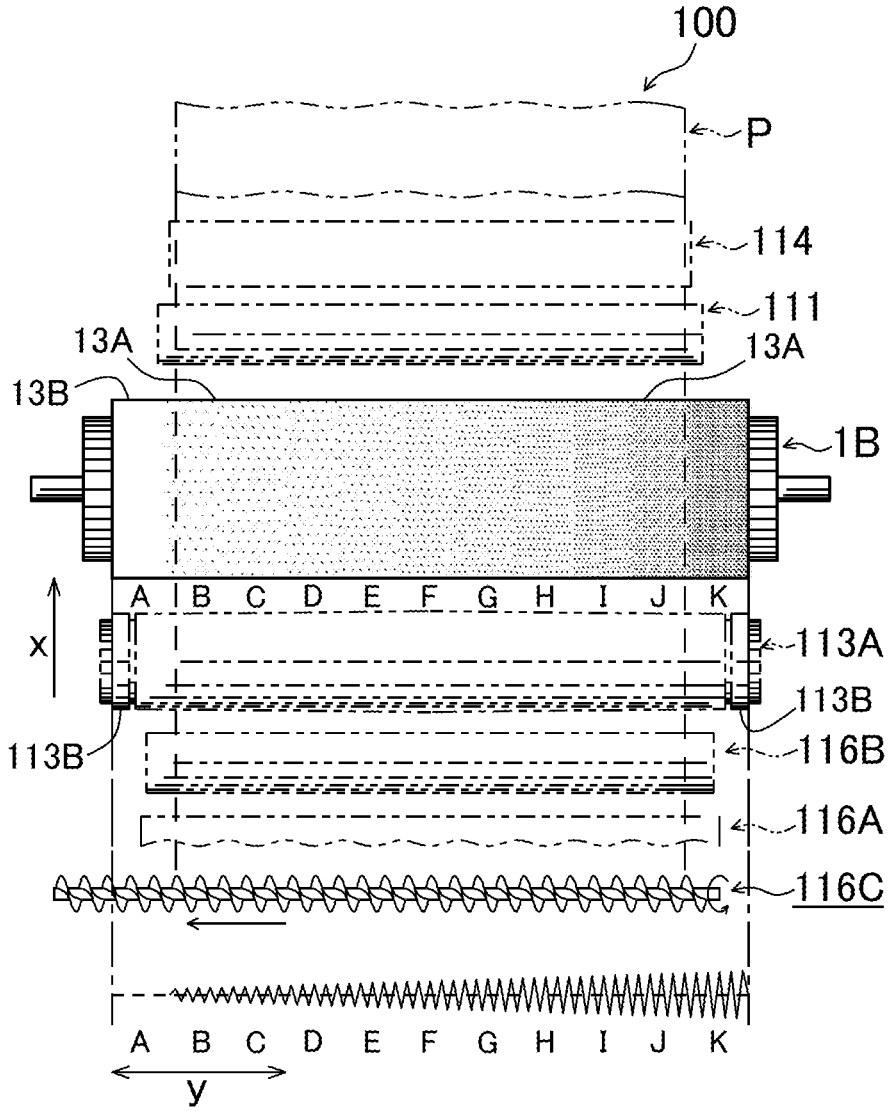
FIG. 5 is an exploded perspective view illustrating a relationship between surface roughness of an electrophotographic photoreceptor according to a second embodiment and peripheral members and a schematic view visually illustrating a change in surface roughness of the outer circumferential surface of a cylindrical substrate 10 of an electrophotographic photoreceptor 1B in the width direction as a difference between a peak and a valley.

Next, the electrophotographic photoreceptor 1B according to the second embodiment illustrated in FIG. 5 addresses a case where a larger amount of the used residual toner T2 used as an external additive for cleaning (sliding and polishing) the surface of the electrophotographic photoreceptor illustrated in FIG. 3 is retained on the toner discharge side (left side in FIG. 5) in the box structure constituting the cleaning device 116, and thus, more friction (abrasion) is generated on the surface (left side in FIG. 5) of the electrophotographic photoreceptor on the toner retention side.

For this reason, the electrophotographic photoreceptor 1B according to the second embodiment is configured by using a cylindrical substrate 10 (raw tube) including the outer surface of the surface roughness profile as illustrated in FIG. 5. That is, the electrophotographic photoreceptor 1B is formed based on a raw tube which has outer surface roughness which gradually decreases from the other end (second substrate end portion, block K in the right side of the figure) of two substrate end portions in the cylindrical axial direction to one end (first substrate end portion, block A of a mirror surface illustrated in the figure) thereof. In the substrate, the surface roughness of the surface layer 13 of the electrophotographic photoreceptor 1B after the film formation also conforms to the surface shape of the cylindrical substrate 10 (raw tube), and the surface roughness gradually decreases from the other end (second surface-layer end portion, a block K on the right side in the figure) of the two surface-layer end portions in the cylindrical axial direction toward one end portion (first surface-layer end portion, a block A of the mirror surface on the left side in the figure) thereof.

In addition, the surface roughness Sa of the cylindrical substrate 10 (raw tube) of the electrophotographic photoreceptor 1B is, for example, less than 25 nm in the block A at the left end (substrate mirror surface portion) and 119 nm in the block K at the right end. The image printing portion (blocks B to J) in the surface layer 13 of the electrophotographic photoreceptor 1B is a rough surface having a surface roughness Str of 0.67 or more, and the boundary portion between the mirror surface and the rough surface (between the block A and the block B) is formed to be a roughness gradient surface where the surface roughness gradually increases toward the right side similarly to the raw tube according to the first embodiment.

According to the electrophotographic photoreceptor having the above-described configuration, when the electrophotographic photoreceptor is used as an image forming apparatus, similarly to the previous embodiment, it is possible to prevent the peeling of the film (surface layer) at the boundary portion between the mirror surface and the rough surface.

In addition, in the electrophotographic photoreceptor 1B, the outermost surface (the outer circumferential surface of the surface layer 13) of the image printing portion (blocks B to J) is formed to be a rough surface whose surface roughness Str gradually decreases from the other end (second surface-layer end portion) on the right side to one end (first surface-layer end portion on the toner discharge side) on the left side. Therefore, as illustrated in FIG. 5, even in a case where the residual toner T2 is incorporated into the image forming apparatus that discharges the residual toner T2 in the left direction in the figure by the rotation of the toner transporting screw 116C, it is possible to obtain the electrophotographic photoreceptor which withstands the abrasion that frequently occurs on the discharge side of the used residual toner T2 and has a long life cycle.

Figure 6:
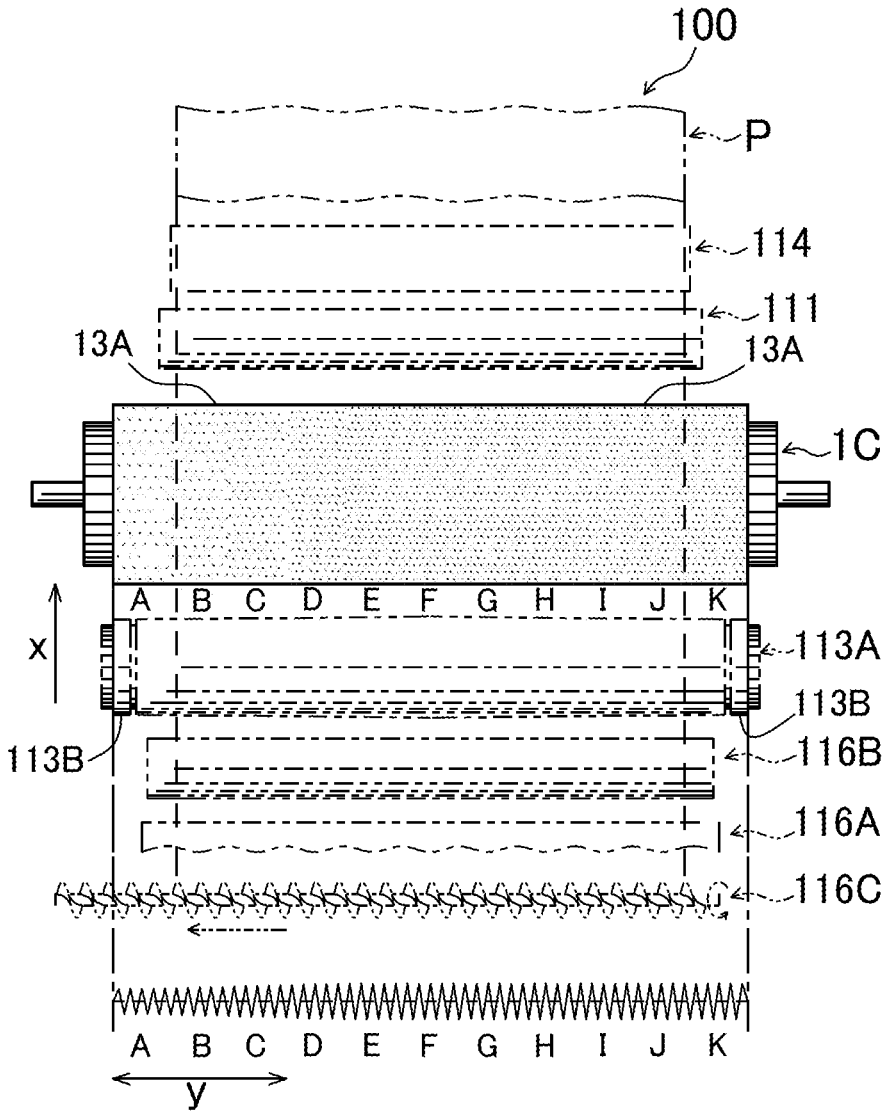
FIG. 6 is an exploded perspective view illustrating a relationship between surface roughness of an electrophotographic photoreceptor according to a third embodiment and peripheral members and a schematic view visually illustrating a change in surface roughness of the outer circumferential surface of a cylindrical substrate 10 of an electrophotographic photoreceptor 1C in the width direction as a difference between a peak and a valley.

In addition, in a case where the surface-layer mirror surface portion (13B) having an Sa of less than 25 nm is not provided in any end portion, the electrophotographic photoreceptor may be configured like the electrophotographic photoreceptor 1C according to the third embodiment illustrated in FIG. 6. In this case, the roughness change profile of the outer surface of the electrophotographic photoreceptor 1C (FIG. 6) and the roughness change of the surface layer 13 of the electrophotographic photoreceptor 1C after the film formation in the cylindrical axial direction, which roughness change conforms to the roughness change profile, are also formed more gently than those of the electrophotographic photoreceptors 1A and 1B according to the first and second embodiments.

In addition, the roughness change (profile) of the outer surface of the electrophotographic photoreceptor 1C and the roughness change of the surface layer 13 of the electrophotographic photoreceptor 1C in the cylindrical axial direction which conforms to the roughness change (profile) of the outer surface gradually increases from the first end portion on the left side (first substrate end portion and first surface-layer end portion) to the central portion (substrate central portion and surface-layer central portion), and in the right half in the figure, the surface roughness hardly change in the surface-layer central portion.

The surface roughness Sa of the cylindrical substrate 10 (raw tube) of the electrophotographic photoreceptor 1C is, for example, 75 nm in the block A at the left end and 90 nm in the block F at the substrate central portion. In addition, the surface roughness Str of the image printing portions (blocks B to J) in the surface layer 13 of the electrophotographic photoreceptor 1C after the film formation is 0.91 in the block B on the left and 0.93 in the block F in the surface-layer center.

Also in the electrophotographic photoreceptor 1C having the above-described configuration, the change in the surface roughness Str of the surface layer is gentle, so that it is possible to prevent the peeling of the film (surface layer) due to the aged use.

Figure 7:
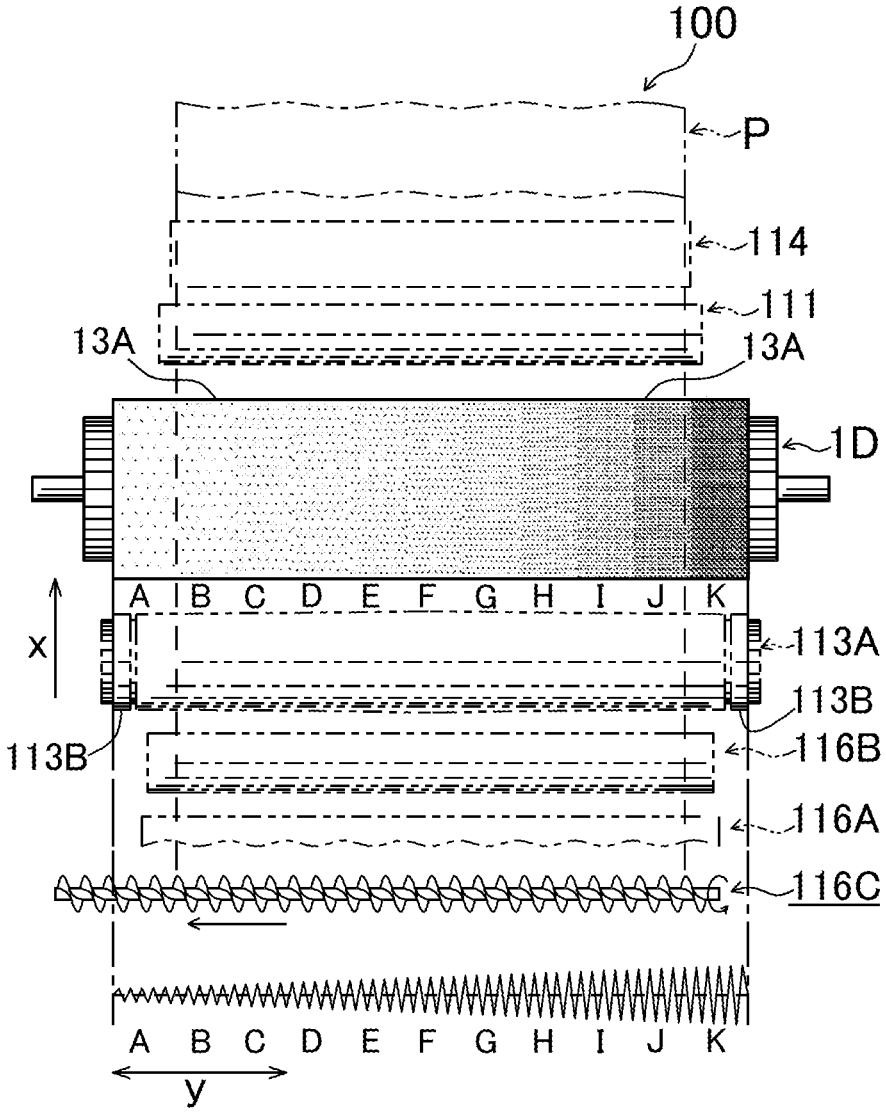
FIG. 7 is an exploded perspective view illustrating a relationship between surface roughness of an electrophotographic photoreceptor according to a fourth embodiment and peripheral members and a schematic view visually illustrating a change in surface roughness of the outer circumferential surface of a cylindrical substrate 10 of an electrophotographic photoreceptor 1D in the width direction as a difference between a peak and a valley.

In addition, in a case where the substrate mirror surface portion and the surface-layer mirror surface portion having an Sa of less than 25 nm are not provided in any of the end portions, the electrophotographic photoreceptor may be configured like the electrophotographic photoreceptor 1D according to the fourth embodiment illustrated in FIG. 7.

In this manner, when the roughness change profile of the outer surface of the electrophotographic photoreceptor 1D (FIG. 7) and the roughness change of the surface layer 13 of the electrophotographic photoreceptor 1D after the film formation in the cylindrical axial direction, which conforms to the roughness change profile of the outer surface are configured so as to occur over the entire width in the cylindrical axial direction, similarly to the second embodiment (FIG. 5) described above, it is possible to obtain the electrophotographic photoreceptor which withstands the abrasion which frequently occurs on the discharge side (left side in the figure) of the residual toner T2 and has a long life cycle.

Next, the electrophotographic photoreceptors (1E to 1H) according to the fifth to eighth embodiments illustrated in FIGS. 8 to 11 are configured by using the cylindrical substrates (raw tube) including the outer surface having a surface roughness profile as illustrated in each figure. That is, each of the electrophotographic photoreceptors 1E to 1H is formed based on a raw tube whose roughness (arithmetic mean height Sa) of the outer surface gradually increases from the first substrate end portion (block A on the left side) of one end in the cylindrical axial direction and the second substrate end portion (block K on the right side) of the other end in the axial direction toward the block F of the central portion (substrate central portion) in the axial direction. The surface roughness of the surface layer 13 of each of the electrophotographic photoreceptors 1E to 1H after the film formation also has a shape conforming to the surface shape of the cylindrical substrate 10 (raw tube).

Figure 8:
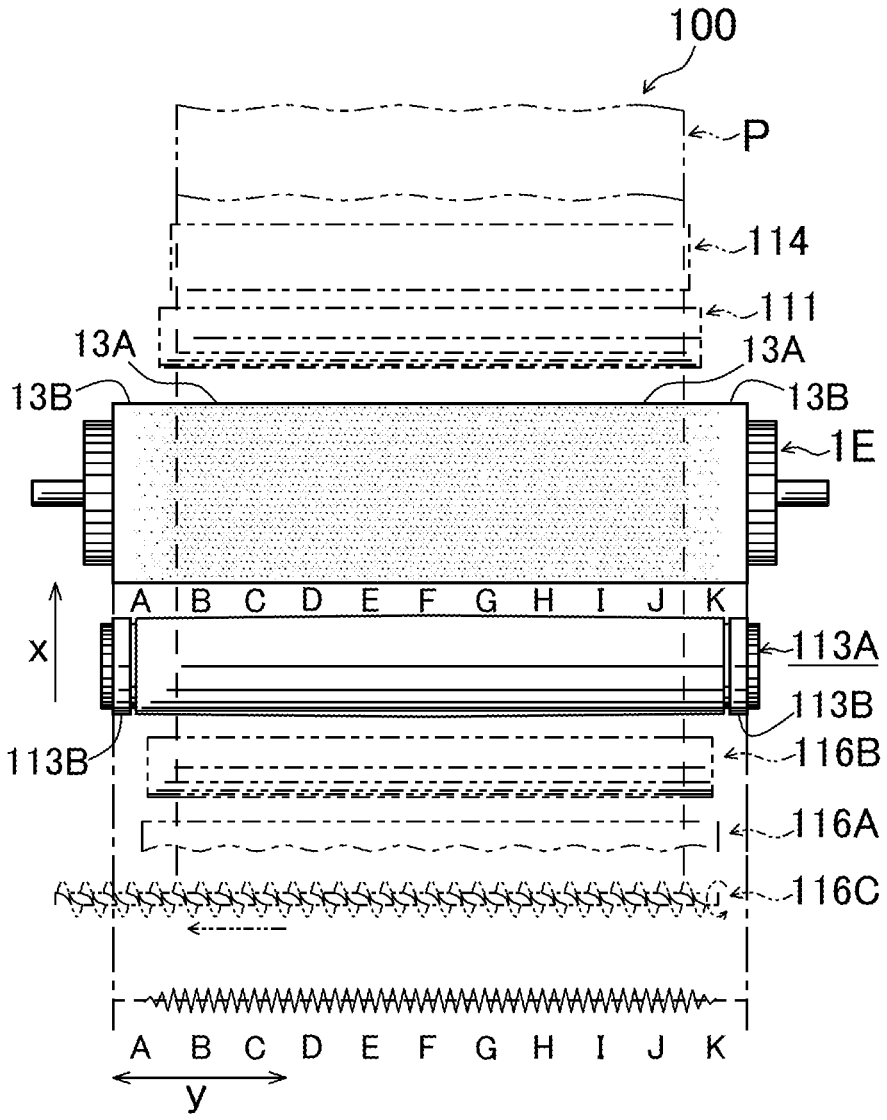
FIG. 8 is an exploded perspective view illustrating a relationship between surface roughness of an electrophotographic photoreceptor according to a fifth embodiment and peripheral members and a schematic view visually illustrating a change in surface roughness of the outer circumferential surface of a cylindrical substrate 10 of an electrophotographic photoreceptor 1E in the width direction as a difference between a peak and a valley.

In more detail, in the image forming apparatus according to the fifth embodiment illustrated in FIG. 8, two rollers 113B and 113B arranged at the two ends of the magnetic roller 113A abut on the outer edge portions at the two ends of the electrophotographic photoreceptor 1E. Therefore, the gap (developing gap) between the magnetic roller 113A and the electrophotographic photoreceptor 1E is regulated, which addresses the occurrence of a large amount of abrasion on the outer edge portions.

That is, the electrophotographic photoreceptor 1E is formed based on a raw tube in which the surface roughness of the substrate central portion (blocks B to J in the figure) of the outer surface is larger than the surface roughness of one end (first substrate end portion, a block A of the mirror surface on the left side in the figure) and the other end (second substrate end portion, a block K on the right side in the figure) of the two ends in the cylindrical axial direction of the outer surface. In the substrate, the surface roughness of the surface layer 13 of the electrophotographic photoreceptor 1E after the film formation also conforms to the surface shape of the cylindrical substrate 10 (raw tube), and the surface roughness of the surface-layer central portion (blocks B to J in the figure) is larger than the surface roughness of one end (first surface-layer end portion, a block A of the mirror surface on the left side in the figure) and the other end (second surface-layer end portion, a block K on the right side in the figure) of the two ends in the cylindrical axial direction.

The surface roughness Sa of the cylindrical substrate 10 (raw tube) of the electrophotographic photoreceptor 1E is, for example, less than 25 nm at the blocks A and K (substrate mirror surface portion) of the substrate end portion and 60 nm at the blocks B to J at the substrate central portion. The image printing portions (blocks B to J) on the surface layer 13 of the electrophotographic photoreceptor 1E are rough surfaces having a surface roughness Str of 0.67 or more. The boundary portion between the mirror surface and the rough surface (between the blocks A and B and between the blocks J and K) is formed to be a roughness gradient surface where the surface roughness gradually increases toward the surface-layer central portion similarly to the raw tube according to the first embodiment.

According to the electrophotographic photoreceptor having the above-described configuration, since the outer edge portions at the two ends of the electrophotographic photoreceptor 1E that slidingly contacts the rollers 113B at the two ends of the magnetic roller 113A are mirror surfaces, there is less abrasion on the surface layer at these positions, and thus, initial performance can be maintained for a long time. In addition, since the outermost surface (outer circumferential surface of surface layer 13) of the image printing portion (blocks B to J) that contacts the peripheral members such as the cleaning roller (sliding roller) and the cleaning blade is formed to be a rough surface with a surface roughness of Str≥0.67, even when the electrophotographic photoreceptor is used repeatedly many times, the image abnormalities are unlikely to occur, and the life of the electrophotographic photoreceptor 1E can be extended.

Figure 9:
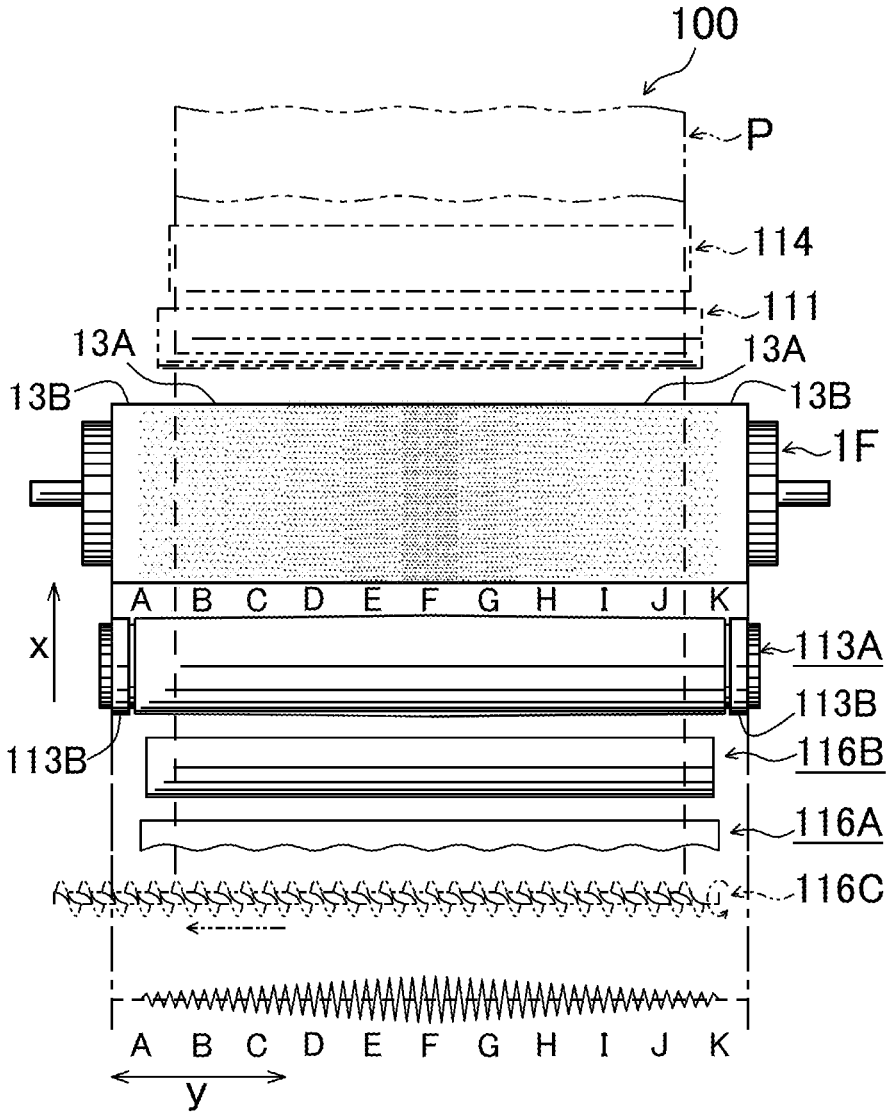
FIG. 9 is an exploded perspective view illustrating a relationship between surface roughness of an electrophotographic photoreceptor according to a sixth embodiment and peripheral members and a schematic view visually illustrating a change in surface roughness of the outer circumferential surface of a cylindrical substrate 10 of an electrophotographic photoreceptor 1F in the width direction as a difference between a peak and a valley.

Next, the electrophotographic photoreceptor 1F according to the sixth embodiment illustrated in FIG. 9 addresses a case where the cleaning roller (sliding roller) 116B of the cleaning device 116 illustrated in FIG. 3 is in a shape such as a crown shape by taking into consideration of the abrasion of the central portion and the contact pressure to the electrophotographic photoreceptor 1F at the two ends of the cleaning roller 116B is increased.

That is, the electrophotographic photoreceptor 1F is formed based on a raw tube which has outer surface roughness gradually increases from one end (first substrate end portion, a block A of the mirror surface on the left side in the figure) and the other end (second substrate end portion, a block K on the right side in the figure) to the substrate central portion (F in the figure) of the two ends in the cylindrical axial direction. In the substrate, the surface roughness of the surface layer 13 of the electrophotographic photoreceptor 1E after the film formation also conforms to the surface shape of the cylindrical substrate 10 (raw tube), and the surface roughness gradually increases from one end (first surface-layer end portion, a block A of the mirror surface on the left side in the figure) and the other end (second surface-layer end portion, a block K on the right side in the figure) of the two ends in the cylindrical axial direction toward the surface-layer central portion (F in the figure)

The surface roughness Sa of the cylindrical substrate 10 (raw tube) of the electrophotographic photoreceptor 1F is, for example, less than 25 nm in the blocks A and K (substrate mirror surface portion) in the substrate end portion and 110 nm in the block F in the substrate central portion. The image printing portions (blocks B to J) in the surface layer 13 of the electrophotographic photoreceptor 1F are rough surfaces having a surface roughness Str of 0.67 or more, and the boundary portion between the mirror surface and the rough surfaces (between the blocks A and B and the blocks J and K) is formed to be a roughness gradient surface where the surface roughness gradually increases toward the surface-layer central portion similarly to the raw tube of the above-described embodiment.

According to the electrophotographic photoreceptor having the above-described configuration, since the outer edge portions at the two ends of the electrophotographic photoreceptor 1F that slidingly contacts the rollers 113B at the two ends of the magnetic roller 113A are mirror surfaces (surface-layer mirror surface portions 13B), there is less abrasion on the surface layer at these positions, and the initial performance can be maintained for a long time. In addition, the outermost surface (outer circumferential surface of surface layer 13) of the image printing portion (blocks B to J) that contacts peripheral members such as a cleaning roller (sliding roller) is formed to be a rough surface having a surface roughness Str≥0.67 and is formed to be a rough surface whose surface roughness Str increases toward the surface-layer central portion. As a result, even in a case where the contact pressure to the electrophotographic photoreceptor 1F at the two ends of the cleaning roller 116B is set to be high, it is possible to reduce the abrasion of this portion having a high contact pressure. Therefore, the electrophotographic photoreceptor 1F can also be an electrophotographic photoreceptor with a long life.

Figure 10:
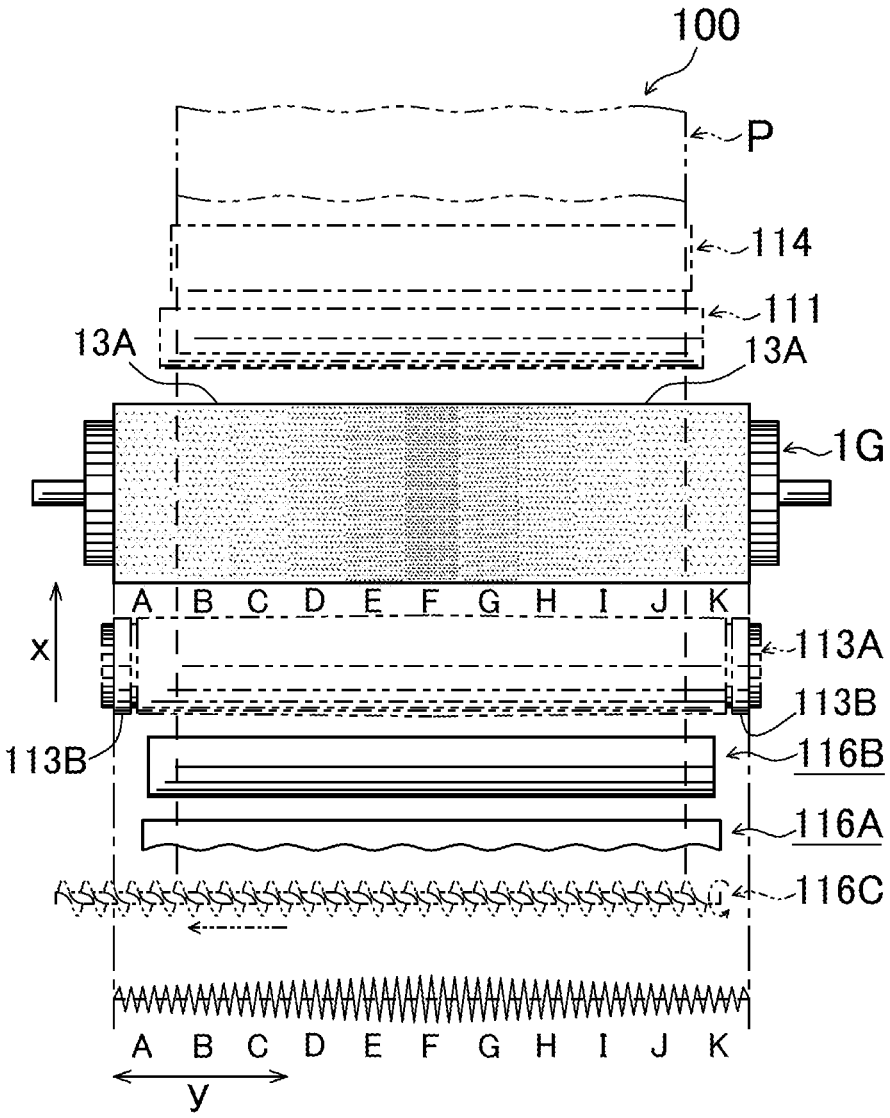
FIG. 10 is an exploded perspective view illustrating a relationship between surface roughness of an electrophotographic photoreceptor according to a seventh embodiment and peripheral members and a schematic view visually illustrating a change in surface roughness of the outer circumferential surface of a cylindrical substrate 10 of an electrophotographic photoreceptor 1G in the width direction as a difference between a peak and a valley.

In addition, in a case where the surface-layer mirror surface portion (Sa is less than 25 nm) area is not provided in the two end portions in the cylindrical axial direction, the electrophotographic photoreceptor 1G according to the seventh embodiment illustrated in FIG. 10 can be configured. Also in this case, the outermost surface (the outer circumferential surface of the surface layer 13) of the image printing portion (blocks B to J) that contacts the peripheral member such as the cleaning roller is formed to be a rough surface having a surface roughness of Str≥0.67 and is formed to be a rough surface whose surface roughness Str increases toward the surface-layer central portion.

The surface roughness Sa of the cylindrical substrate 10 (raw tube) of the electrophotographic photoreceptor 1G is, for example, 60 nm in the blocks A and K at both left and right ends and 119 nm in the block F in the substrate central portion. In addition, the surface roughness Str of the image printing portions (blocks B to J) in the surface layer 13 of the electrophotographic photoreceptor 1G after the film formation is 0.89 in the left and right blocks A and K and 0.97 in the block F in the surface-layer central portion.

According to the electrophotographic photoreceptor having the above-described configuration, the outermost surface (outer circumferential surface of the surface layer) of the image printing portion (blocks B to J) that contacts the crown-shaped cleaning roller has a surface roughness of Str≥0.67 and is formed to be a rough surface whose surface roughness gradually increases from the two surface-layer end portions to the surface-layer central portion, and thus, even in a case where the contact pressure to the electrophotographic photoreceptor 1G at the two ends of the cleaning roller 116B is set to be high, it is possible to reduce the abrasion of this portion having a high contact pressure. Therefore, the electrophotographic photoreceptor 1G can also be an electrophotographic photoreceptor with a long life.

Figure 11:
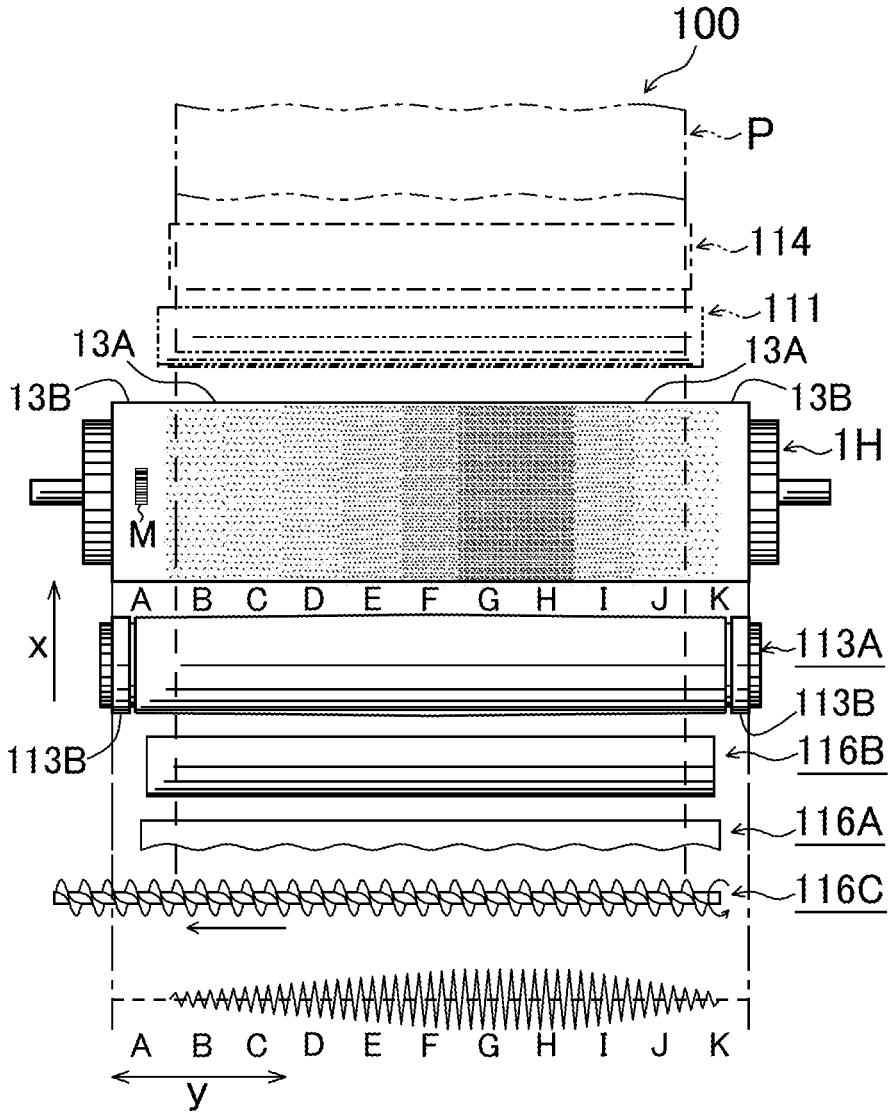
FIG. 11 is an exploded perspective view illustrating a relationship between surface roughness of an electrophotographic photoreceptor according to an eighth embodiment and peripheral members and a schematic view visually illustrating a change in surface roughness of the outer circumferential surface of a cylindrical substrate 10 of an electrophotographic photoreceptor 1H in the width direction as a difference between a peak and a valley.

Next, the electrophotographic photoreceptor 1H of the eighth embodiment illustrated in FIG. 11 addresses a case where the cleaning roller (sliding roller) 116B of the cleaning device 116 is in a crown shape by taking into consideration of the abrasion of the central portion and the outlet for an external additive (used residual toner T2) for cleaning the electrophotographic photoreceptor is provided on the left side in the figure.

That is, the features of the surface roughness profile (FIG. 11) of the outer circumferential surface of the electrophotographic photoreceptor 1H in the state of the raw tube (cylindrical substrate 10) before forming the surface layer are that a rough surface is formed such that the surface roughness gradually increases from the first substrate end portion (left side in the figure) of one end in the cylindrical axial direction and the second substrate end portion (right side in the figure) of the other end in the axial direction to the substrate central portion in the center in the axial direction and the maximum point of the surface roughness is arranged to be offset from the substrate central portion to the blocks G and H on the right side in the figure by taking into consideration of the abrasion which frequently occurs on the discharge side due to the retention of the used residual toner T2. In addition, as described above, the maximum point of the surface roughness is deviated to the right from the substrate central portion, and this is because, in the profile (FIG. 9) of the eighth embodiment, similarly to the profile according to the preceding second embodiment (refer to FIG. 5), the surface roughness overlaps the profile gradually decreasing toward the left end (the first substrate end portion on the toner discharge side).

The surface roughness Sa of the cylindrical substrate 10 (raw tube) of the electrophotographic photoreceptor 1H is, for example, less than 25 nm in the blocks A and K (substrate mirror surface) of the substrate end portion and 119 nm in the blocks G and H near the substrate central portion, and thus, the surface roughness of the surface layer 13 of the electrophotographic photoreceptor 1H after the film formation is also in a shape conforming to the surface shape of the cylindrical substrate 10 (raw tube). Furthermore, the image printing portions (blocks B to J) in the surface layer 13 of the electrophotographic photoreceptor 1H are rough surfaces having a surface roughness Str of 0.67 or more, and the Str of the blocks G and H located near the surface-layer center is 0.91. And, the boundary portion between the mirror surface and the rough surface (between the blocks A and B and between the blocks J and K) is formed to be a roughness gradient surface where the surface roughness gradually increases toward the surface-layer central portion.

In addition, similarly to the first embodiment, the surface-layer mirror surface portion 13B (block A), which is a mirror surface on one end side, is provided with an identification portion M whose surface roughness is larger than that of the mirror surface at one location in the circumferential direction. This identification portion is provided at a position deviated from the position (outer edge in the figure) in which the roller 113B supporting the magnetic roller 113A abuts, and a bar code (individual identification code section) using surface roughness (line mark) that changes in the circumferential direction is formed.

According to the electrophotographic photoreceptor having the above-described configuration, the outer edge portions at the two ends of the electrophotographic photoreceptor 1H that slidingly contacts the rollers 113B at the two ends of the magnetic roller 113A are mirror surfaces (surface-layer mirror surface portions 13B), so that there is less abrasion on the layer at this position. In addition, since the outermost surface (the outer circumferential surface of the surface layer 13) of the image printing portion (blocks B to J) that contacts the peripheral member such as the cleaning roller is formed to be a rough surface having a surface roughness of Str≥0.67, even when the electrophotographic photoreceptor is used repeatedly many times, image abnormalities are unlikely to occur. In addition, the abrasion that frequently occurs on the discharge side of the used residual toner T2 is also reduced. Due to these synergetic effects, it is possible to realize an electrophotographic photoreceptor with excellent durability and an image forming apparatus using the same, in which image abnormalities is unlikely to occur even when the electrophotographic photoreceptor is used repeatedly for many times and for a long time.

In summary of the various configurations of the electrophotographic photoreceptor according to the embodiment of the present disclosure as described above, it can be said that the technical scope claimed in this embodiment is an electrophotographic photoreceptor including a cylindrical substrate, and a surface layer located on an outer surface of the cylindrical substrate, in which at least in the substrate central portion in the cylindrical axial direction of the outer surface of the cylindrical substrate is formed as a rough surface, the surface roughness of the surface-layer central portion in the cylindrical axial direction of the outer surface of the surface layer is larger than that of at least one of the two surface-layer end portions in the cylindrical axial direction of the outer surface of the surface layer, and the surface roughness of the substrate central portion in the cylindrical axial direction of the outer surface of the cylindrical substrate is larger than that of at least one of the two substrate end portions in the axial direction of the outer surface of the cylindrical substrate.

In addition, the technical scope claimed in the embodiment includes the electrophotographic photoreceptor in which the surface roughness of the outer surface of the cylindrical substrate gradually increases from the first substrate end portion to the second substrate end portion of the both substrate end portions.

Furthermore, the technical scope claimed in the embodiment includes the electrophotographic photoreceptor in which the surface roughness of the outer surface of the cylindrical substrate gradually increases from at least one of both substrate end portions to the substrate central portion.

Furthermore, the technical scope claimed in the embodiment includes the electrophotographic photoreceptor in which at least one of both substrate end portions of the outer surface of the cylindrical substrate includes a substrate mirror surface portion including a mirror surface having a surface roughness of Sa<25 nm.

The technical scope claimed in the embodiment includes the electrophotographic photoreceptor in which the substrate mirror surface portion includes the identification portion whose surface roughness is larger than that of the mirror surface at a portion excluding an outer edge in the cylindrical axial direction.

In addition, the present disclosure is not limited to only the ones illustrated in the above-described embodiments, and improvements and changes can be made without departing from the scope of the present disclosure.

For example, in the above-described embodiments, the cylindrical substrate 10, the charge injection blocking layer 11*a*, and the photoconductive layer 11*b* are described as separate components, but alternatively, at least the surface of the cylindrical substrate 10 may have a charge injection blocking characteristic. According to such constitution, the cylindrical substrate 10 itself can have a function of blocking injection of carriers (electrons) from the cylindrical substrate 10 to the photoconductive layer 11*b* without separately providing the charge injection blocking layer 11*a*.

REFERENCE SIGNS LIST

1: Electrophotographic photoreceptor
1A to 1H: Electrophotographic photoreceptor
2: Plasma CVD apparatus
3: Support
4: Vacuum reaction chamber
5: Rotating means
6: Raw material gas supply means
7: Exhaust means
10: Cylindrical substrate
11: Photosensitive layer
11*a*: Charge injection blocking layer
11*b*: Photoconductive layer
12: Surface protective layer
13: Surface layer
13A: Surface-layer rough surface portion
13B: Surface-layer mirror surface portion
30: Flange portion
31: Conductive support column
32: Insulating material
33: Guide plate
34: DC power supply
35: Control unit
36: Ceramic pipe
37: Heater
38: Dummy substrate
38A: Lower dummy substrate
38B: Intermediate dummy substrate
38C: Upper dummy substrate
40: Cylindrical electrode
41, 42: Plate
43, 44: Insulating member
42A, 44A: Gas outlet
45*a*, 45*b*: Gas inlet
46: Gas blow-off hole
49: Pressure gauge
50: Rotation motor
51: Rotational force transmission mechanism
52: Rotation introducing terminal
53: Insulating shaft member
54: Insulating flat plate
60 to 63: Raw material gas tank
64: Dopant-dedicated gas tank
60A to 64A, 65*a*, 65*b*: Pipe
60B to 64B, 60C to 64C: Valve
60D to 64D: Mass flow controller
71: Mechanical booster pump
72: Rotary pump
100: Image forming apparatus
111: Charging device
112: Exposure device
113: Developing device
113A: Magnetic roller
113B: Roller
113C: Toner transporting screw for stirring
114: Transfer device
114A: Transfer charger
114B: Separation charger
115: Fixing device
115A, 115B: Fixing roller
116: Cleaning device
116A: Cleaning blade
116B: Cleaning roller
116C: Toner transporting screw for discharging
117: Static eliminating device
P: Recording medium
T: Developer (toner)
T1: Unused toner
T2: Residual toner

The invention claimed is:

1. An electrophotographic photoreceptor, comprising:
a cylindrical substrate, at least a substrate central portion in a cylindrical axial direction of an outer surface of the cylindrical substrate having a surface roughness; and
a surface layer located on the outer surface of the cylindrical substrate,
a surface roughness of a surface-layer central portion in a cylindrical axial direction of an outer surface of the surface layer being larger than a surface roughness of at least one of two surface-layer end portions in the cylindrical axial direction of the outer surface of the surface layer.

2. The electrophotographic photoreceptor according to claim 1, wherein the surface roughness of the outer surface of the surface layer gradually increases from a first surface-layer end portion to a second surface-layer end portion of the two surface-layer end portions.

3. The electrophotographic photoreceptor according to claim 1, wherein the surface roughness of the outer surface of the surface layer gradually increases from at least one of the two surface-layer end portions to the surface-layer central portion.

4. The electrophotographic photoreceptor according to claim 1, wherein the at least one of the two surface-layer end portions of the outer surface of the surface layer comprises a surface-layer mirror surface portion comprising a mirror surface, wherein a surface roughness of the mirror surface is Sa<25 nm.

5. The electrophotographic photoreceptor according to claim 4, wherein the surface-layer mirror surface portion has an identification portion, excluding an outer edge in the cylindrical axial direction, wherein the surface roughness of the identification portion is larger than the surface roughness of the mirror surface.

6. The electrophotographic photoreceptor according to claim 1, wherein the surface roughness of the substrate central portion in the cylindrical axial direction of the outer surface of the cylindrical substrate is larger than a surface roughness of at least one of two substrate end portions in the cylindrical axial direction of the outer surface of the cylindrical substrate.

7. The electrophotographic photoreceptor according to claim 1, wherein the surface layer comprises amorphous silicon (a-Si).

8. The electrophotographic photoreceptor according to claim 1, wherein the surface layer comprises an organic material.

9. An image forming apparatus, comprising:
the electrophotographic photoreceptor according to claim 1; and
a peripheral member capable of contacting a surface of the electrophotographic photoreceptor.

* * * * *